United States Patent [19]

Shill

[11] Patent Number: 5,026,249

[45] Date of Patent: Jun. 25, 1991

[54] APPARATUS FOR STACKING CORRUGATED SHEET MATERIAL

[75] Inventor: David Shill, Spokane, Wash.

[73] Assignee: Thermoguard Equipment, Inc., Spokane, Wash.

[21] Appl. No.: 358,256

[22] Filed: May 26, 1989

[51] Int. Cl.[5] ..... B31B 1/14

[52] U.S. Cl. ..... 414/789.1; 414/790.8; 414/791.1; 414/793.8; 414/794.4; 198/689.1; 198/458; 271/197; 271/218

[58] Field of Search ..... 414/788.9, 789.1, 790.8, 414/791.1, 792.7, 793, 793.1, 793.8, 794.4; 198/458, 471.1, 689.1, 861.1, 817, 839; 271/198, 215, 217, 218, 197

[56] References Cited

U.S. PATENT DOCUMENTS

| | | | |
|---|---|---|---|
| 1,569,033 | 1/1926 | Reichel | 414/789.1 |
| 2,205,767 | 6/1940 | Lamb . | |
| 2,895,552 | 7/1959 | Pomper et al. . | |
| 3,022,999 | 2/1962 | Mead . | |
| 3,362,707 | 1/1968 | Lauren . | |
| 3,550,493 | 12/1970 | Benbenek et al. | 414/791.1 X |
| 3,577,892 | 3/1971 | Moore | 414/789.1 X |
| 3,603,448 | 9/1971 | Okano et al. | 198/689.1 X |
| 3,659,840 | 5/1972 | Ruck | 271/197 X |
| 3,698,707 | 10/1972 | Lucas | 414/791.1 X |
| 3,764,024 | 10/1973 | Mojden | 198/689.1 X |
| 3,860,232 | 1/1975 | Martin | 198/458 X |
| 3,880,420 | 4/1975 | Martin | 414/788.9 X |
| 3,892,168 | 7/1975 | Grobman . | |
| 3,905,487 | 9/1975 | Hoke et al. | 414/789.1 |
| 3,977,671 | 8/1976 | Taylor et al. | 414/789.1 X |
| 4,133,523 | 1/1979 | Berthelot | 271/215 X |
| 4,222,697 | 9/1980 | Vits | 414/790.8 |
| 4,406,359 | 9/1983 | Cole et al. | 198/689.1 X |
| 4,433,774 | 2/1984 | Lopes | 198/689.1 X |
| 4,500,243 | 2/1985 | Ward, Jr. et al. . | |
| 4,530,632 | 7/1985 | Sela | 198/689.1 X |
| 4,652,197 | 3/1987 | Littleton | 414/790.8 |
| 4,740,193 | 4/1988 | Frost et al. . | |
| 4,799,847 | 1/1989 | Bodewein | 414/790.8 |

OTHER PUBLICATIONS

Product advertisement for Greene Line Mfg. Corp., Marion, Indiana, "Greene Line Has the Answer? . . . ", date unknown.

Product advertisement for Geo. M. Martin Company, Emeryville, California, "Martin Takes a Good Thing and Makes It Better" (date unknown).

Product advertisement for ASC Machine Tools, Inc., Spokane, Washington, "ASC's Complete Line of Equipment for the Corrugated Industry", (date unknown).

Product advertisement for Owen's Machinery, Inc., Corydon, Indiana, "The Owen's Machinery, Inc. Rotary Die Cut Stacker", (date unknown).

*Primary Examiner*—Frank E. Werner
*Assistant Examiner*—John Vanden Bosche
*Attorney, Agent, or Firm*—Wells, St. John & Roberts

[57] ABSTRACT

A corrugated container blank stacker 10 is described for receiving rows of container blanks 12 from a sheet cutter and for stacking the container blanks in rows of stacks on a pallet. In the embodiment shown the stacker is able to receive container blanks in rows of three abreast and then forming three rows of stacks, three abreast, on a pallet.

16 Claims, 23 Drawing Sheets

148
124
122
108
114
184
188
186
188
202
194
198
196
208
200

APPARATUS FOR STACKING CORRUGATED SHEET MATERIAL

TECHNICAL FIELD

This invention relates to stacking apparatus for feeding and stacking of corrugated container blank sheet material utilizing endless belt conveyor having vacuum pressure for holding the blanks to the conveyor. Such apparatus is classified in class 271, subclass 197.

BACKGROUND OF THE INVENTION

The present invention is designed for receiving multiple paperboard container blanks that have been cut from corrugated sheet material in a rotary die cutter.

Such rotary die cutters normally eject the cut blanks at a lineal exit speed of several hundred if not thousands of feet per minute. Such an outfeed speed presents a very significant problem in providing equipment that is capable of efficiently stacking such blanks without either damaging the blanks or slowing the operation of the rotary die cutter. The blanks are rather fragile and can be easily damaged. The problem has existed for a number of years. An attempt to provide responsive stacking equipment such is shown in the Lamb U.S. Pat. No. 2,205,767 issued June 25, 1970. Recently further attempts have been made from equipment illustrated in the Ward et al. U.S. Pat. No. 4,500,243 issued Feb. 19, 1985 and the Frost U.S. Pat. No. 4,740,193 issued Apr. 26, 1988.

One of the principal objects of this invention is to provide a corrugated container blank stacker that is capable of operating at very high speeds without damaging the fragile container blanks.

These and other objects and advantages of this invention will become apparent upon reading the following detailed description of a preferred embodiment.

BRIEF DESCRIPTION OF THE DRAWINGS

The preferred embodiment of the invention is illustrated in the accompanying drawings, in which:

FIG. 2B shows the two rows of three side-by-side container blanks being separated longitudinally into two rows; and FIG. 2C shows a second step in which the side-by-side blanks are being laterally separated;

FIGS. 3A–3C is a sequence of perspective views showing rows of stacks of container blanks on a pallet in which FIG. 3A shows a first row of three side-by-side stacks; FIG. 3B shows two rows of stacks; and FIG. 3C shows three rows of stacks of container blanks;

FIG. 4 is a side view of a preferred embodiment of the corrugated container blank stacker illustrating a transfer conveyor aligned with the rotary die cutter for receiving the corrugated blanks and for initially moving the blanks from the transfer conveyor to an inclined arcuate main conveyor for conveying the blanks to an elevated position at a stacking station for stacking the container blanks on a platform such as a pallet, in the sequence illustrated in FIGS. 3A–C;

FIG. 7 is a side view similar to FIG. 6 except showing the transfer conveyor in the lower aligned position for normal operation;

FIG. 10 is a vertical cross sectional view taken along line 10—10 in FIG. 6 illustrating a portion of a rear end of the main conveyor;

FIG. 12 is a perspective view of a portion of the transfer conveyor illustrating an infeed section and an outfeed section that overlap and are laterally spaced from each other;

FIG. 13 is a perspective view of the rear end of the main conveyor illustrating drive elements for laterally adjusting conveyor elements laterally with respect to each other;

FIG. 15 is a vertical cross sectional view taken along line 15—15 in FIG. 14 illustrating several of the main conveyor elements and drive mechanisms for laterally adjusting the position of the elements with respect to each other;

FIG. 16 is a fragmentary side view of the stacking station illustrating an elevator located at the stacking station for receiving the container blanks fed by the main conveyor and for stacking the container blanks in the sequence illustrated in FIGS. 3A–C;

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
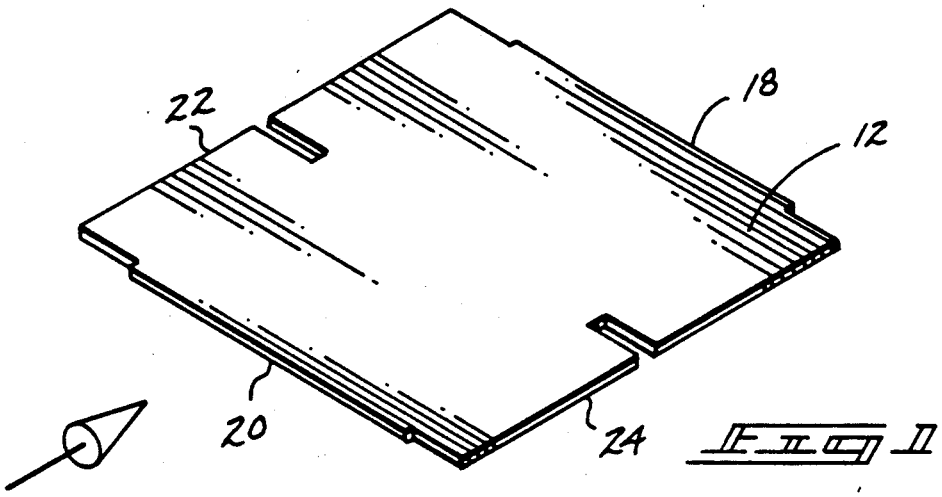
FIG. 1 is a perspective view of a single corrugated container blanks that is cut from a sheet of corrugated material at an upstream corrugated die cutter and fed to a preferred embodiment of this invention.
Figure 2A:
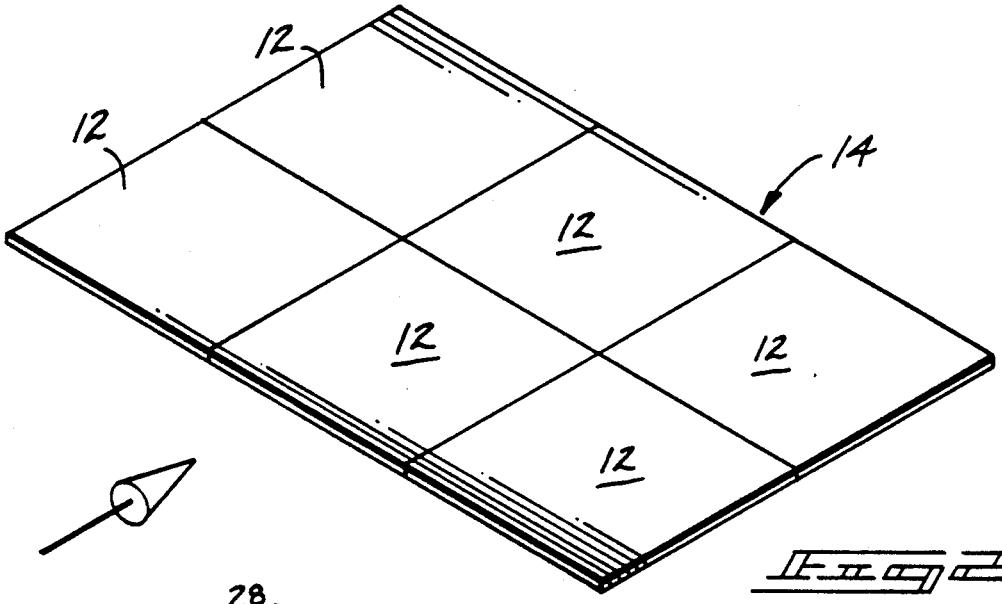
FIGS. 2A–2C are a sequence of perspective views showing a sheet of corrugated material being cut into six container blanks as they are fed from the upstream corrugated die cutter to the corrugated container blank stacker, in which the die cutter cuts the sheet into two rows of three side-by-side container blanks.
Figure 5:
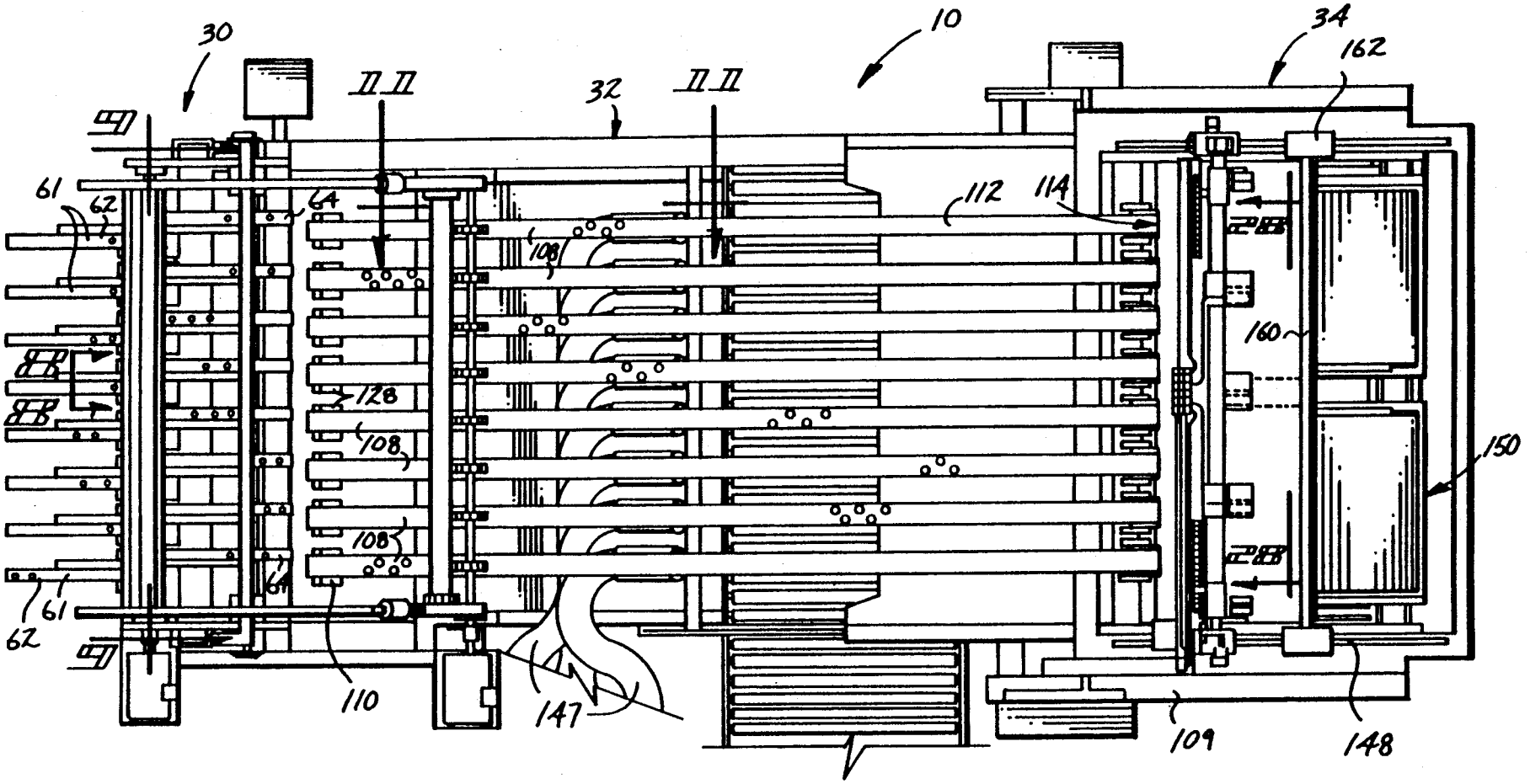
FIG. 5 is a plan view of the corrugated container blank stacker illustrating FIG. 4.

Referring in detail to the drawings, there is illustrated in FIGS. 4 and 5 a corrugated container blank stacker generally designated with the numeral 10. Stacker 10 is intended to handle corrugated container blank 12 that are formed from a corrugated sheet 14 (FIG. 2A). The corrugated sheet is cut by a sheet cutter 16 usually in the form of a rotary die cutter that is upstream of the corrugated container blank stacker 10.

Figure 2B:
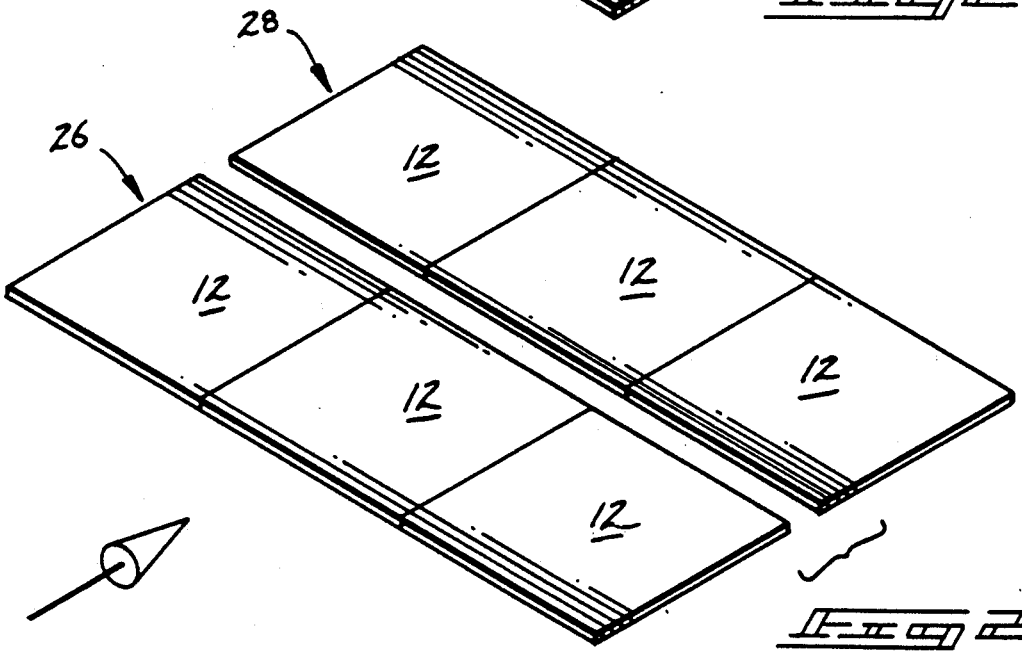
Figure 2C:
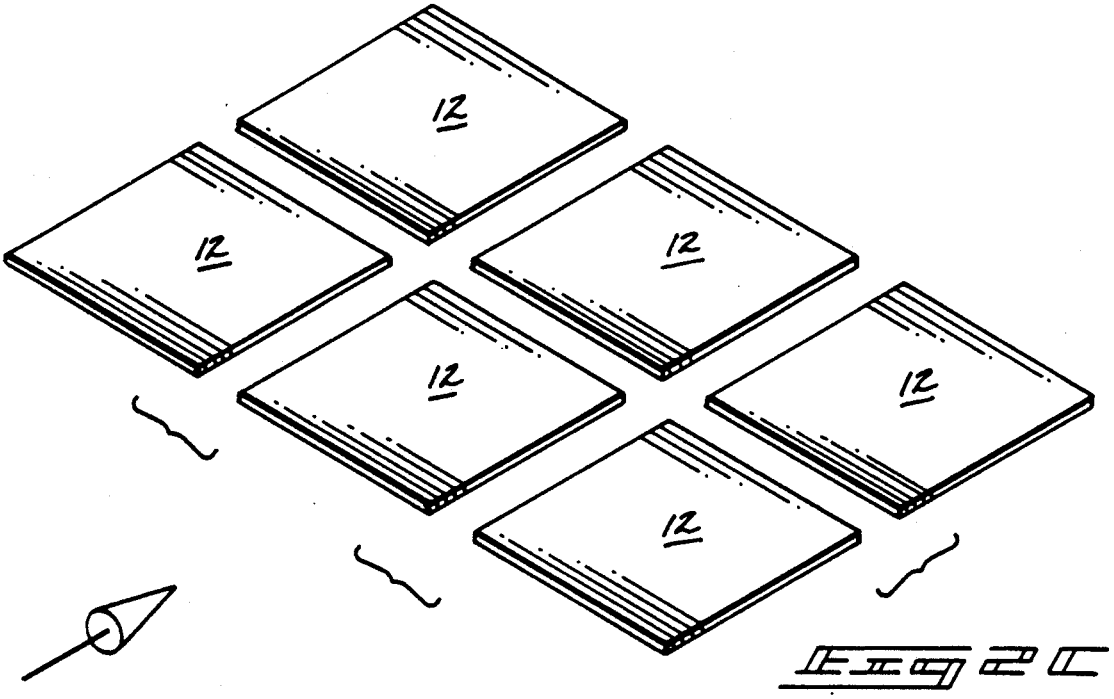

Each container blank 12 includes a forward or front edge 18, a rear edge 20 and side edges 22 and 24. After being cut by the sheet cutter 16 the container blanks are formed in side-by-side blank rows 26 and 28 illustrated in FIGS. 2A–C. FIG. 2A illustrates the arrangement in which the container blanks are normally received by the stacker 10 from the sheet cutter 16. Initially the stacker 10 longitudinally separates the blank rows 26 and 28 as illustrated in FIG. 2B and then laterally separates the blanks in each of the rows 26 and 28 as illustrated in FIG. 2C prior to the container blanks being stacked.

One of the major portions of the stacker 10 is a transfer conveying means generally designated with the numeral 30 (FIGS. 6 and 7) located at a receiving station for receiving the container blanks 12 from the outfeed of the sheet cutter 16. The transfer conveyor means 30 receives the blanks and separates the rows 26 and 28 as illustrated in FIG. 2 prior to depositing the separated rows 26 and 28 onto a main conveyor means 32.

The main conveyor means 32 receives the blanks 12 at a lower position and moves the blanks upward in a curved arc to an elevated position for discharging each row of side-by-side blanks to a blank stacking means 34 located at a stacking station. At the blank stacking means 34 is a storage surface 36 on which the blanks 12 are placed one on top of each other to form stack 38 that are illustrated in FIGS. 3A–C.

Figure 3A:
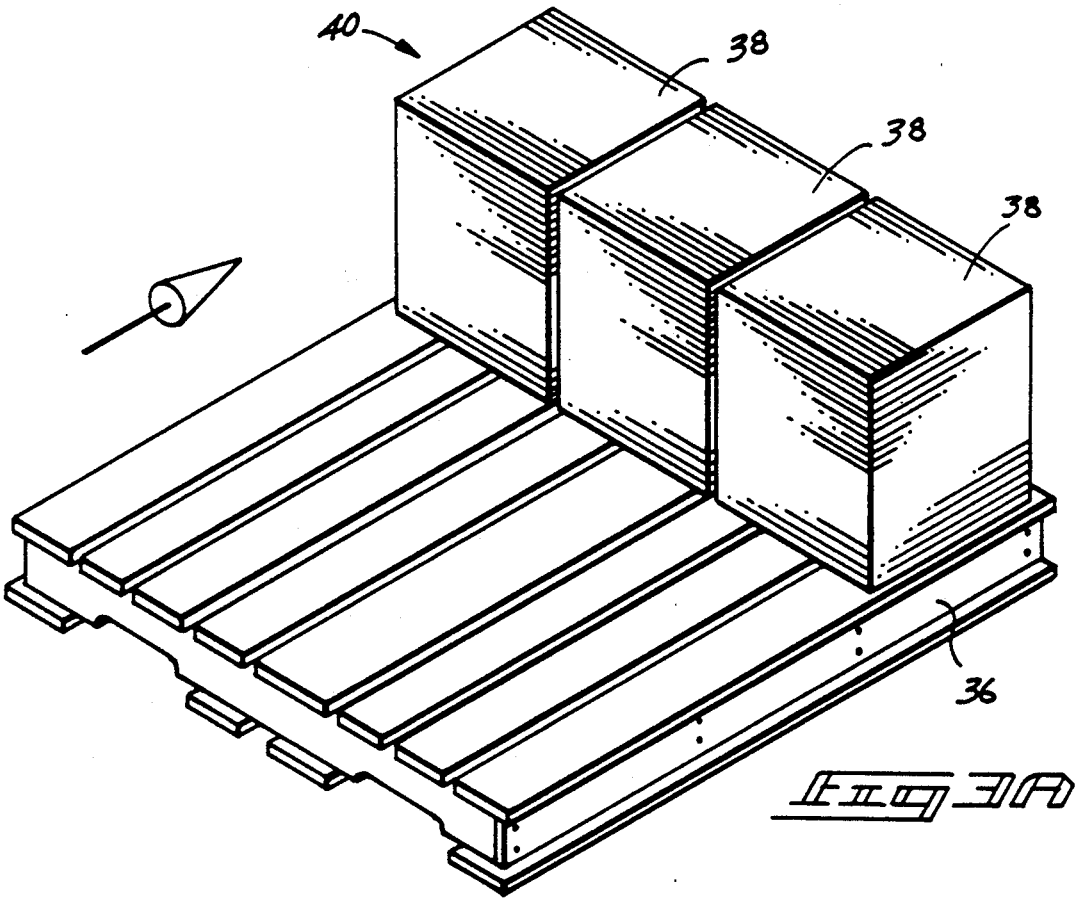
Figure 3B:
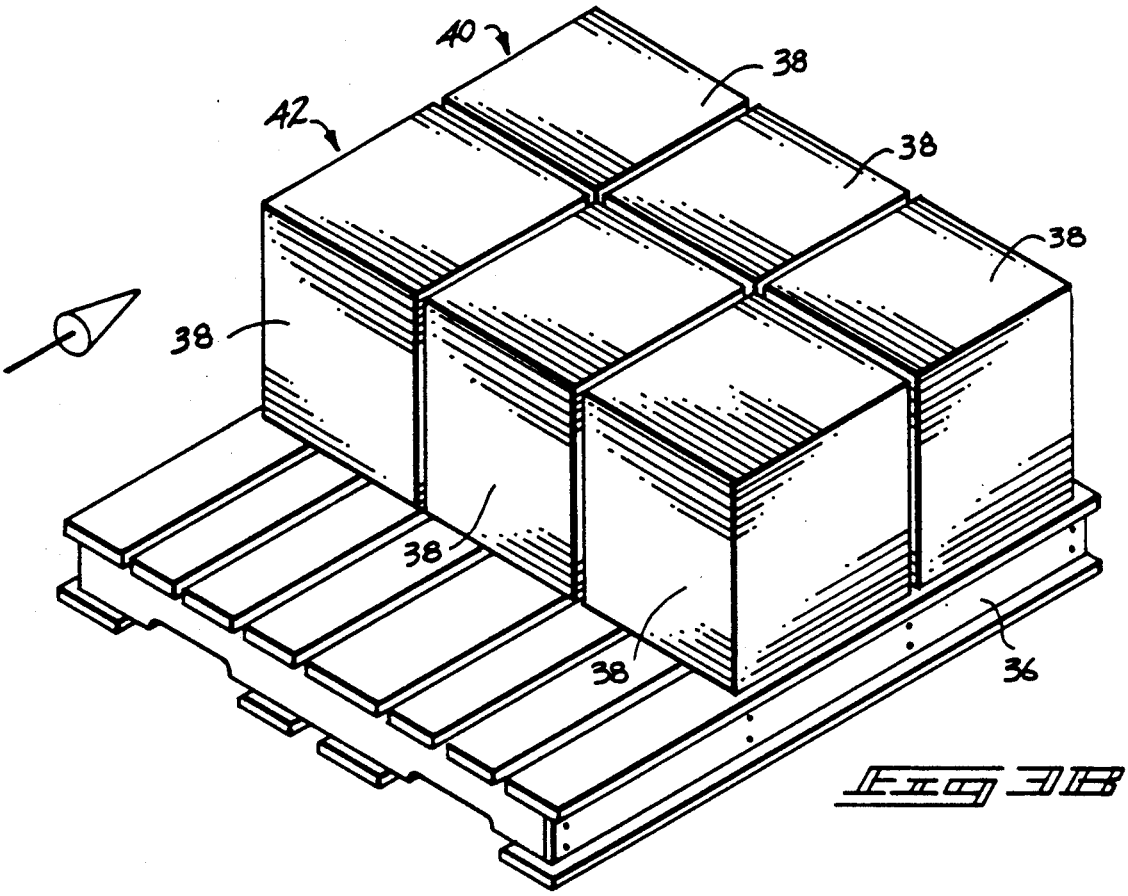
Figure 3C:
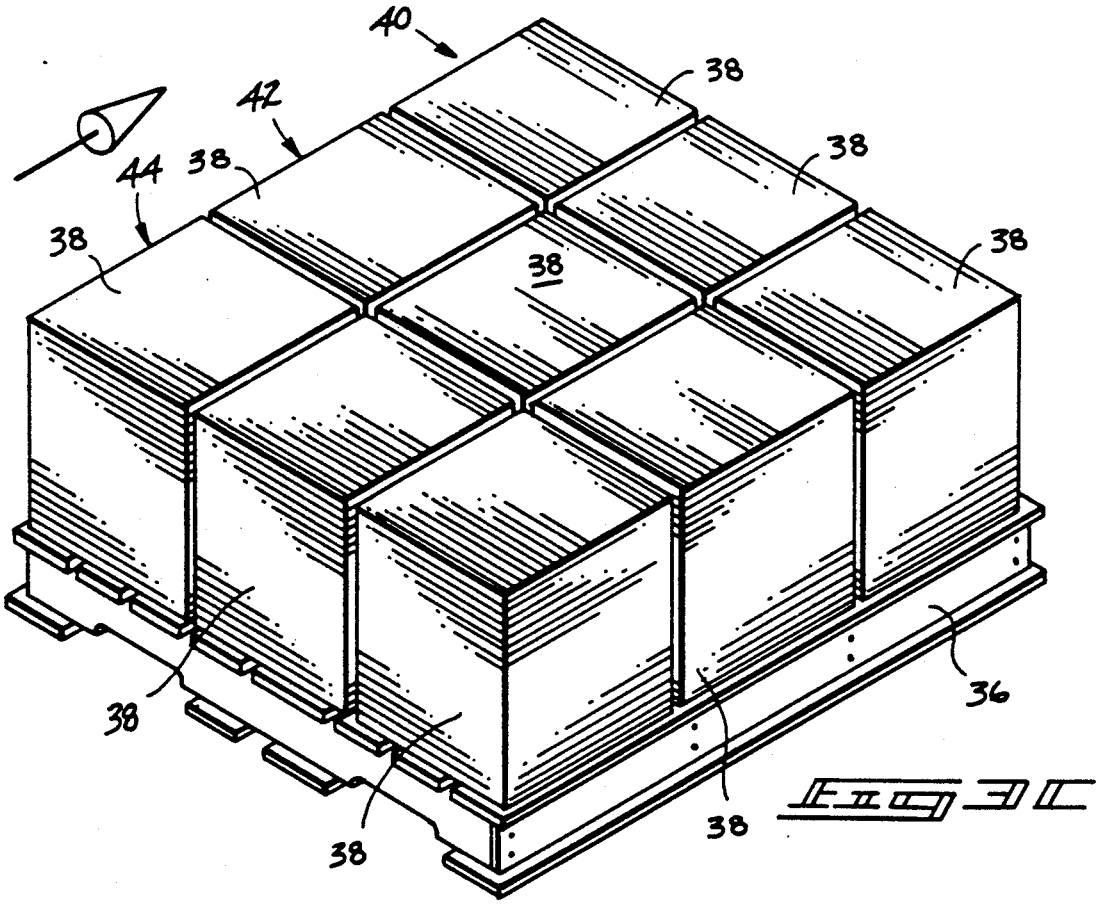

Initially the container blanks 12 are formed into a first row of stacks 40 as illustrated in FIG. 3A. After the first row of stacks is completed then a second row 42 of stacks 38 is prepared and placed on the surface or pallet 36. After the second row 42 stacks 38 has been formed, then a third row 44 of stacks 38 is formed and placed on the pallet 36. The number of rows 40–44 may vary depending upon the size of the corrugated container blanks. Normally at least two rows of stacks 38 will be formed on a single pallet with each row having at least two side-by-side stacks in each row. The pallet 36 after being loaded then is transferred from the stacker 10 to a means of conveying the pallet to a location for storage or shipment.

Transfer Conveying Means

Figure 6:
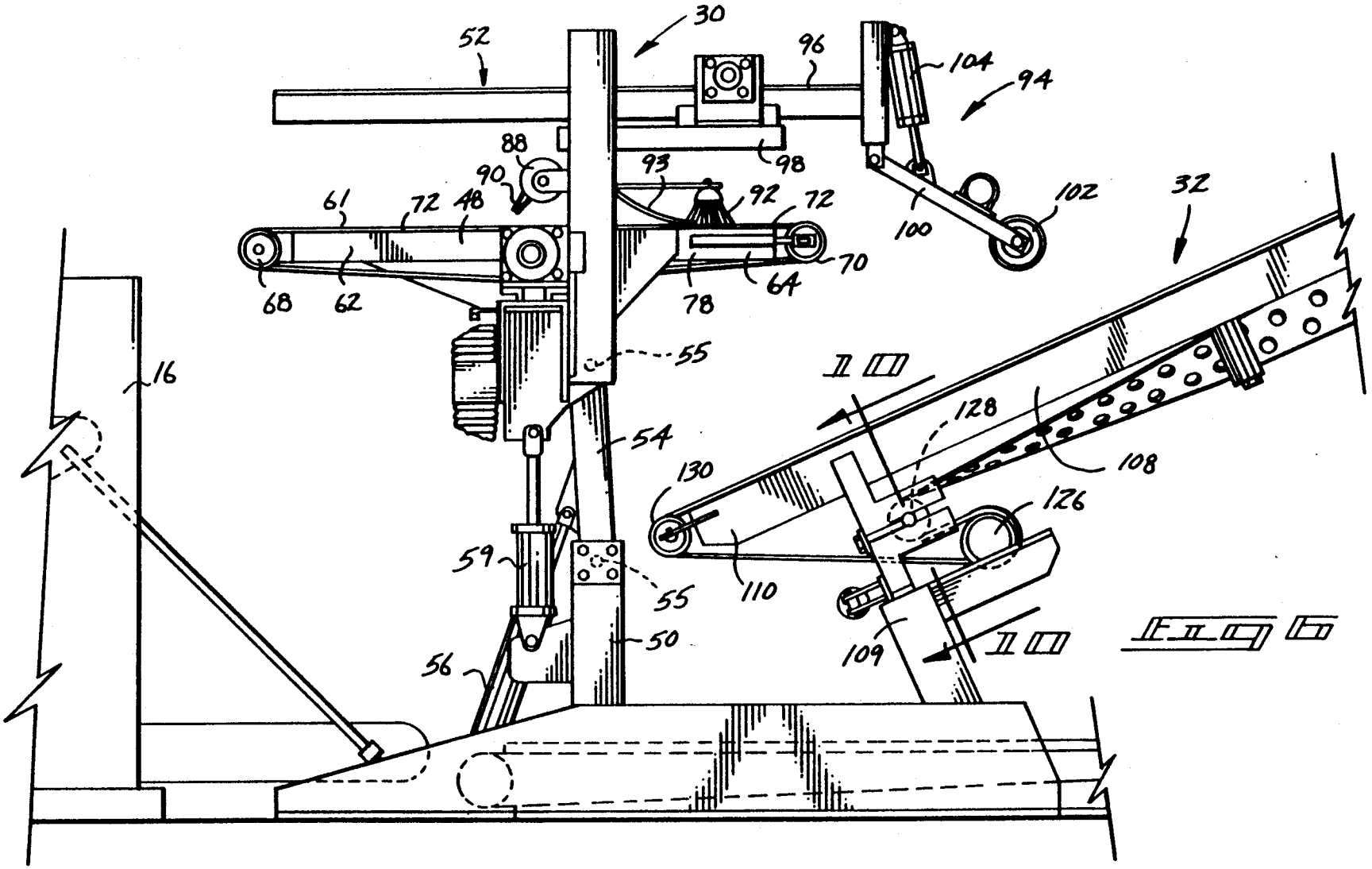
FIG. 6 is an fragmentary side view of a portion of the stacker specifically illustrating the transfer conveyor in an elevated nonoperative position.
Figure 11:
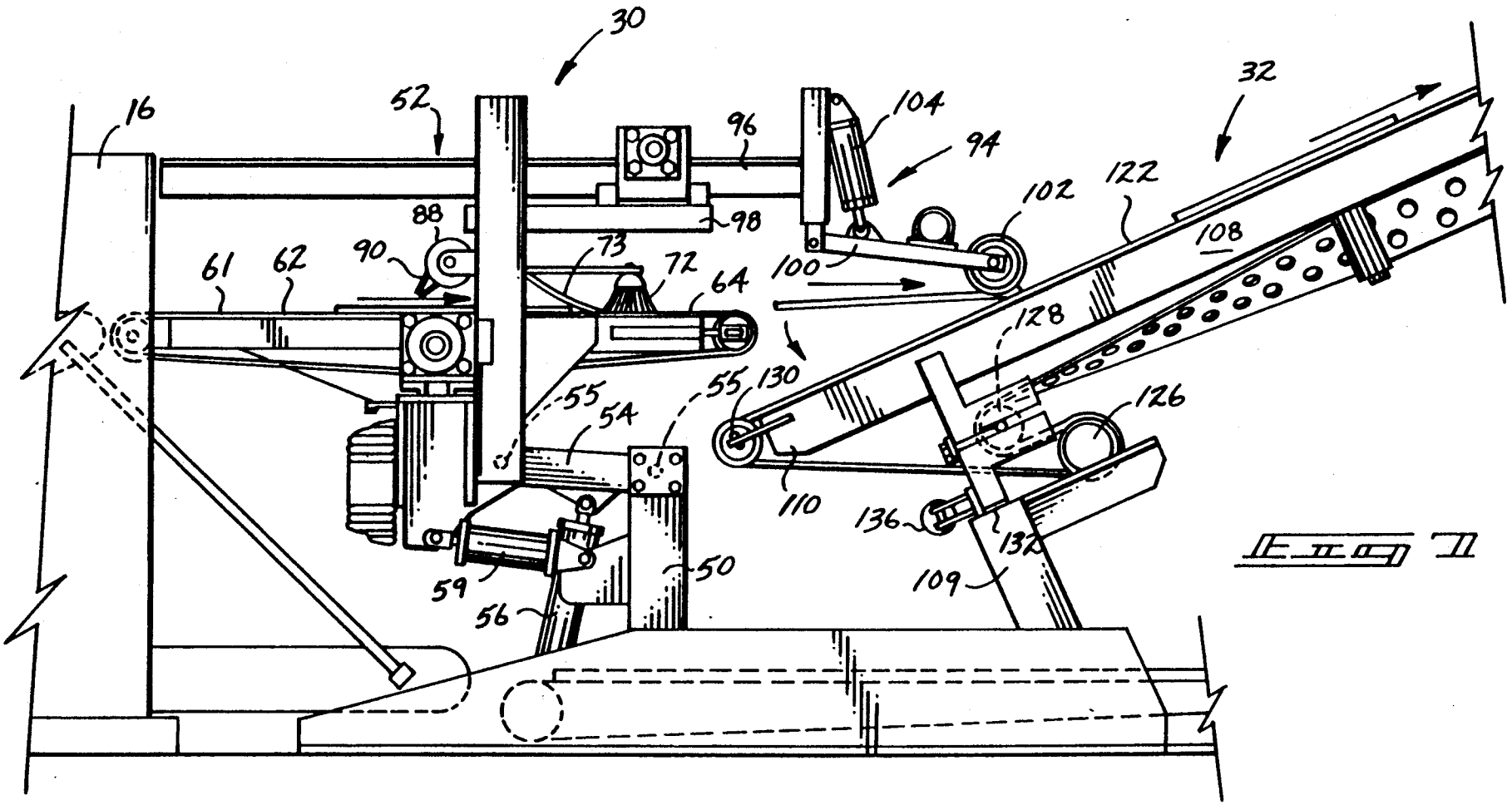

The transfer conveying means 30 (FIGS. 6 and 7) includes a base frame 50 having a vacuum conveying assembly 52 movably mounted on the frame 50 for movement from a lower aligned and operating position illustrated in FIG. 7 to an elevated inoperative position illustrated in FIG. 6. The vacuum conveying assembly 52 is supported on the base frame by support arm 54 that has a pivot bearing 55. A hoist 56, in the form of a cylinder, is provided to selectively raise the vacuum conveying assembly 52 from the operating position illustrated in FIG. 7 to the inoperative position illustrated in FIG. 6. Additionally a tilt drive 59, in the form of a hydraulic cylinder, is provided to raise and lower the assembly 52 in conjunction with the hoist 56 and to tilt the angle of the vacuum conveying assembly 52 about the pivot bearings 55 to orient the angle or inclination of the conveying assembly 52 between the sheet cutter 16 and the main conveying means 32.

The vacuum conveying assembly 52 includes a plurality of laterally spaced conveyor elements 61 (FIGS. 5–7), each including an infeed conveyor section 62 and an outfeed conveyor section 64. Each outfeed conveyor section 64 is laterally offset and partially overlapping the infeed conveyor section 62 as seen in FIGS. 5, 9 and 12.

Figure 9:
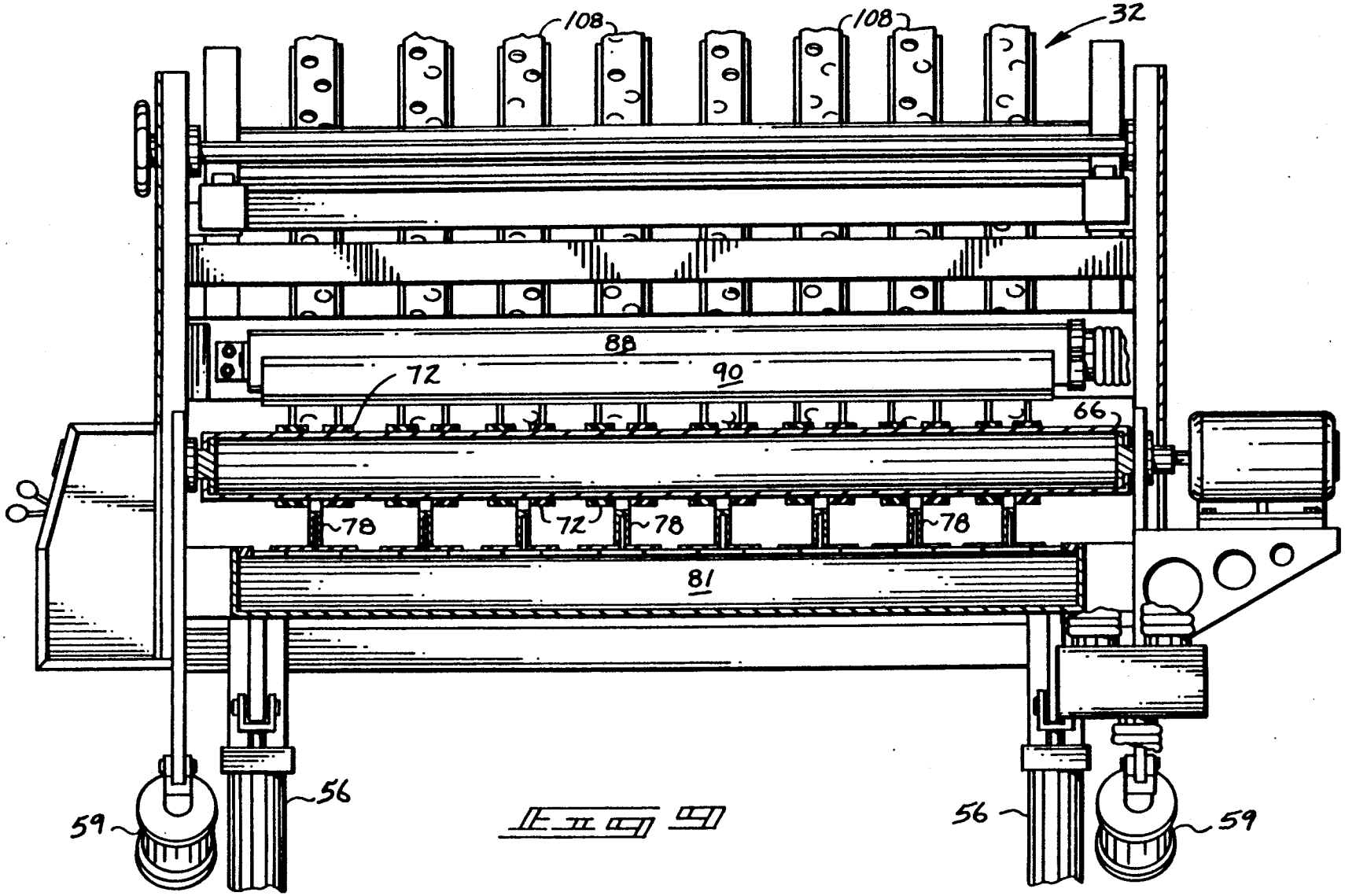
FIG. 9 is a vertical cross sectional view taken along line 9—9 in FIG. 5 illustrating a common roller drive for the transfer conveyor.
Figure 11:
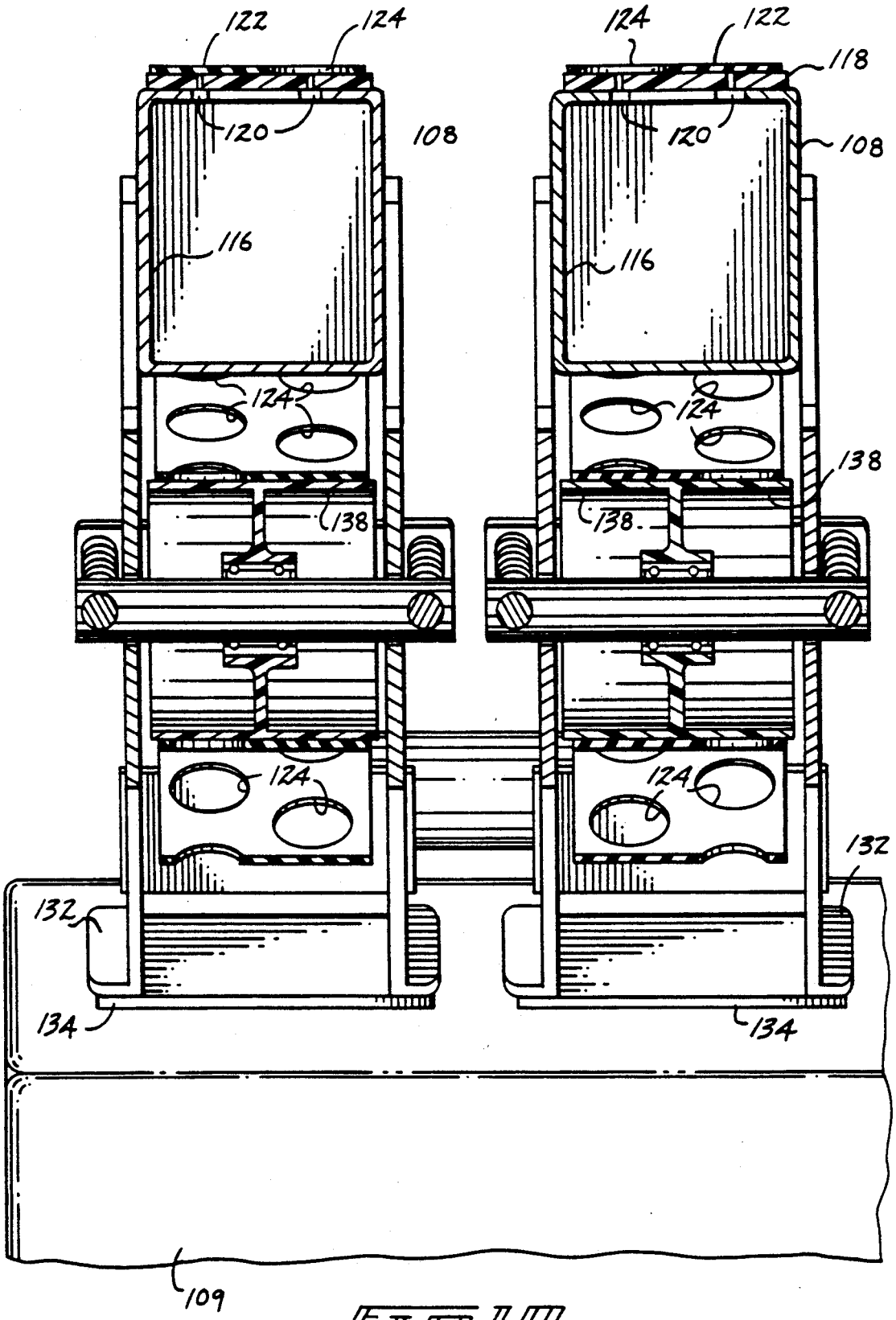
Figure 11:
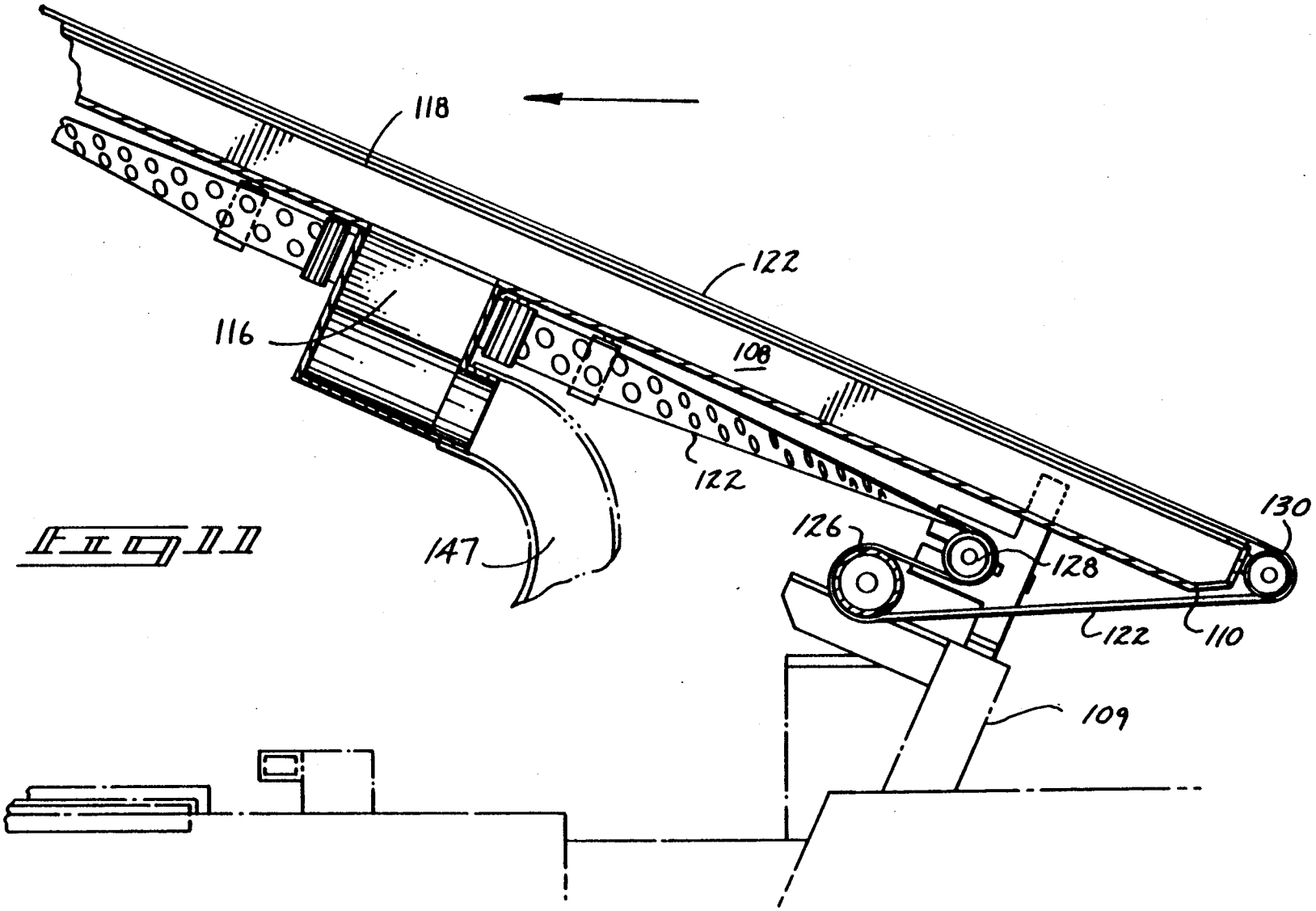
Figure 11:
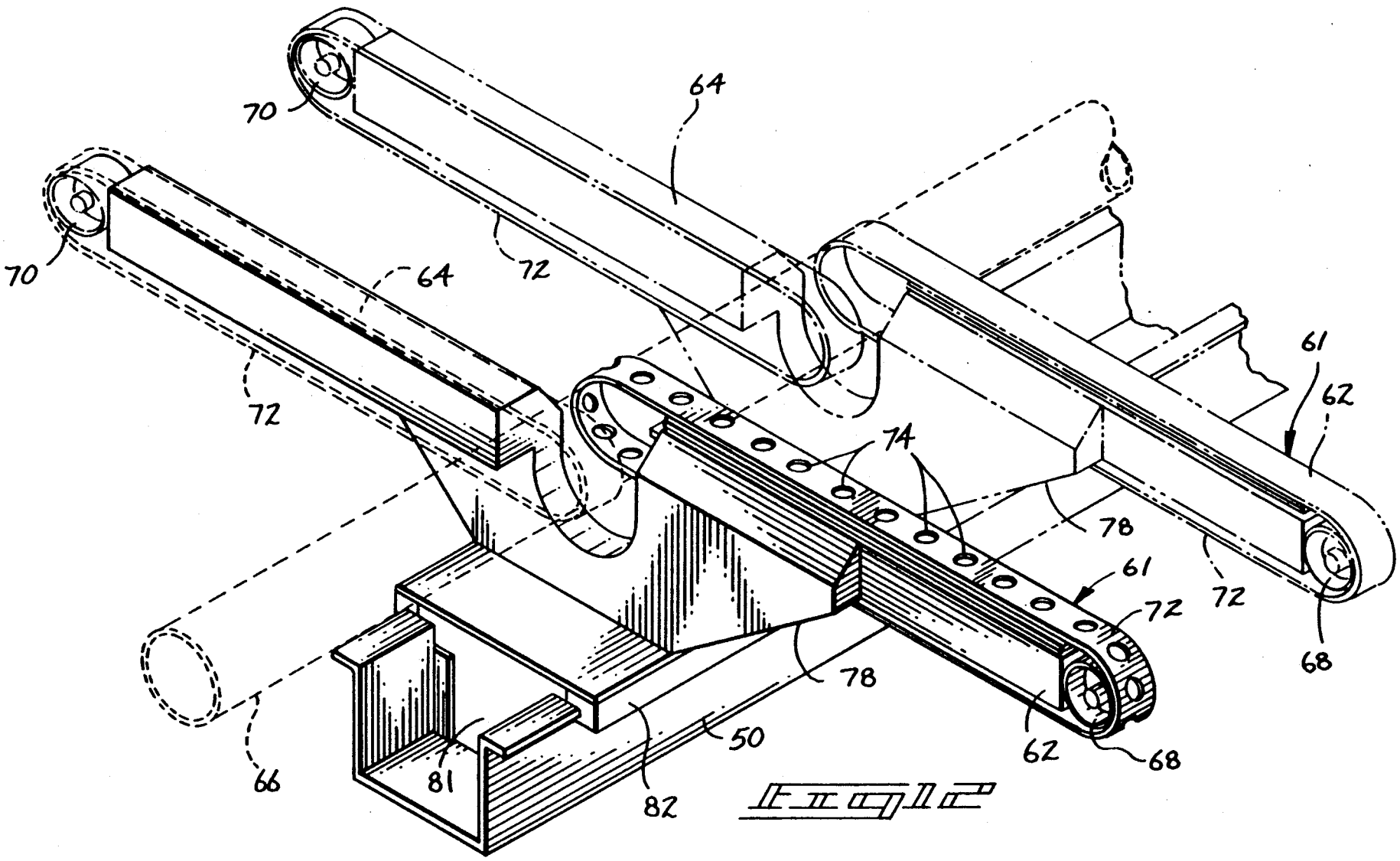
Figure 11:
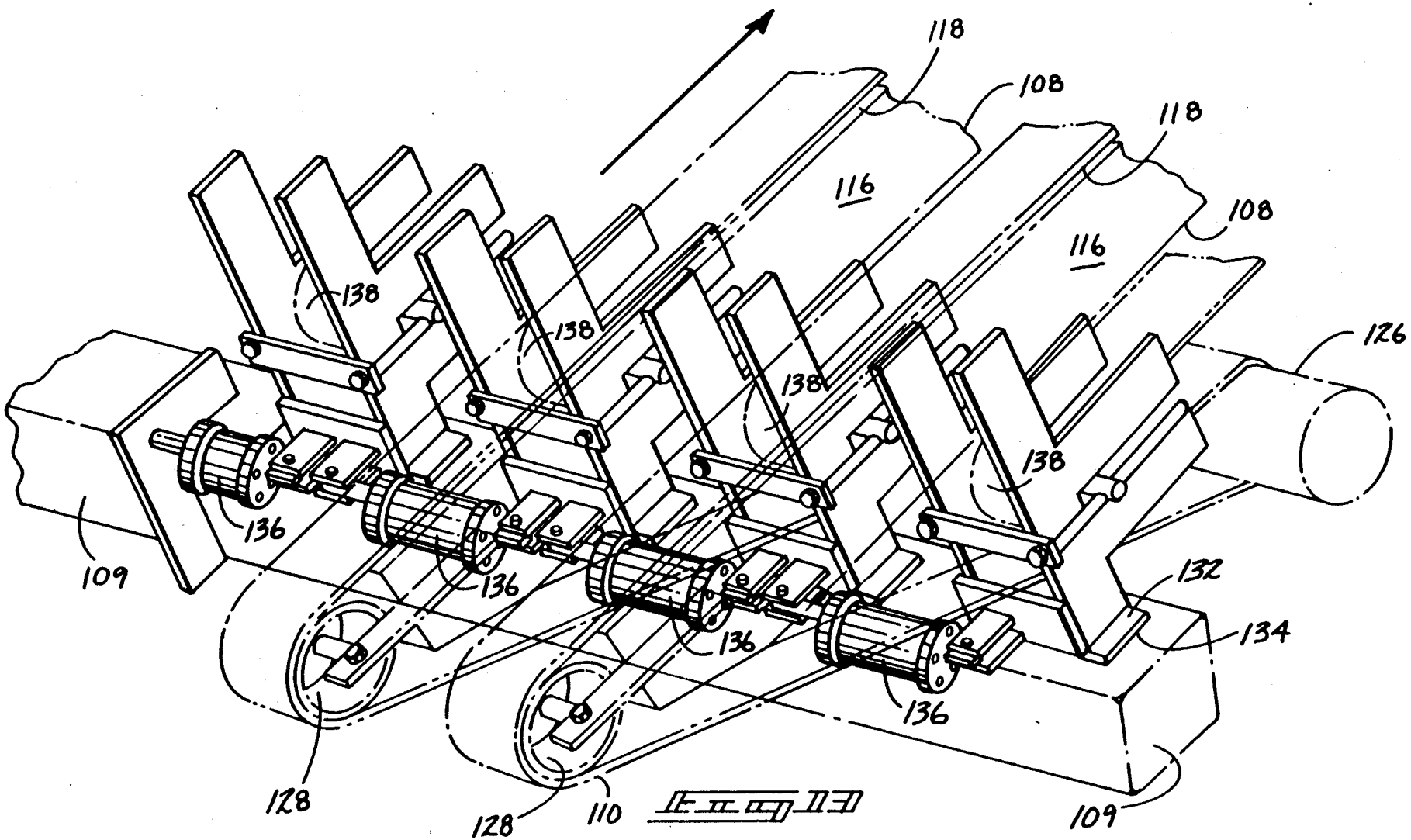

The vacuum conveyor assembly 52 includes a common central belt drive roller 66 illustrated in vertical cross section in FIG. 9 for driving the infeed conveying section 62 and the outfeed conveying section 64. The infeed conveying section 62 includes an idler wheel 68 normally directly opposite the sheet cutter 16. The outfeed conveying section 64 has an idler wheel 70 adjacent the lower end of the main conveyor 32.

Each of the infeed conveyor sections 62 and the outfeed conveyer sections 64 have endless vacuum belts 72 that extend from the common central belt drive roller 66 about their respective idle wheel 68 or 70 for defining an upper flight for receiving the container blanks 12 and conveying the blanks to the main conveyor 32. The peripheral speed of the common central belt drive roller 66 is preferably greater than the outspeed of the sheet cutter 16 to form a longitudinal gap between the first row 26 and the second row 28 as illustrated in FIG. 2B. The separation facilitates the removal of trim material that may be carried by the container blanks 12. Each of the belts 72 has longitudinally spaced apertures 74 that communicate with a vacuum plenum 78 when in the upper flight.

The vacuum plenum 78 has longitudinal slots 80 formed in an upper surface thereof to apply vacuum pressure through the slot 80 and through the apertures in the belts 72 to securely hold the container blanks to the upper flight of the belts 72. As previously mentioned and accented in FIG. 12, the infeed conveyor section 62 and the outfeed conveyor section 64 of each laterally spaced vacuum element 61 is offset with respect to each other so that trim material will not be held against the lower surface of the container blank 12 as blanks are transferred from the sheet cutter 16 to the main conveyor means 32.

Furthermore each of the vacuum conveyor element 61 are individually mounted with respect to a common vacuum plenum 50 (FIGS. 8 and 9) to enable each laterally spaced vacuum conveyor element 61 to be laterally adjusted with respect to each other to accommodate various width container blanks. Each of the individual vacuum plenums 78 are in communication with the common vacuum plenum 50 as illustrated in FIG. 9. Each of the vacuum conveyor elements 61 has a slide bearing 82, illustrated in FIG. 8, supported on the common vacuum plenum 50. An adjustable rack 83 is provided to enable manual movement of each of the vacuum conveying elements 61 independent of the others to adjust their lateral position. The common vacuum plenum 81 is connected to a vacuum line (not shown) that extends to a vacuum source.

Figure 8:
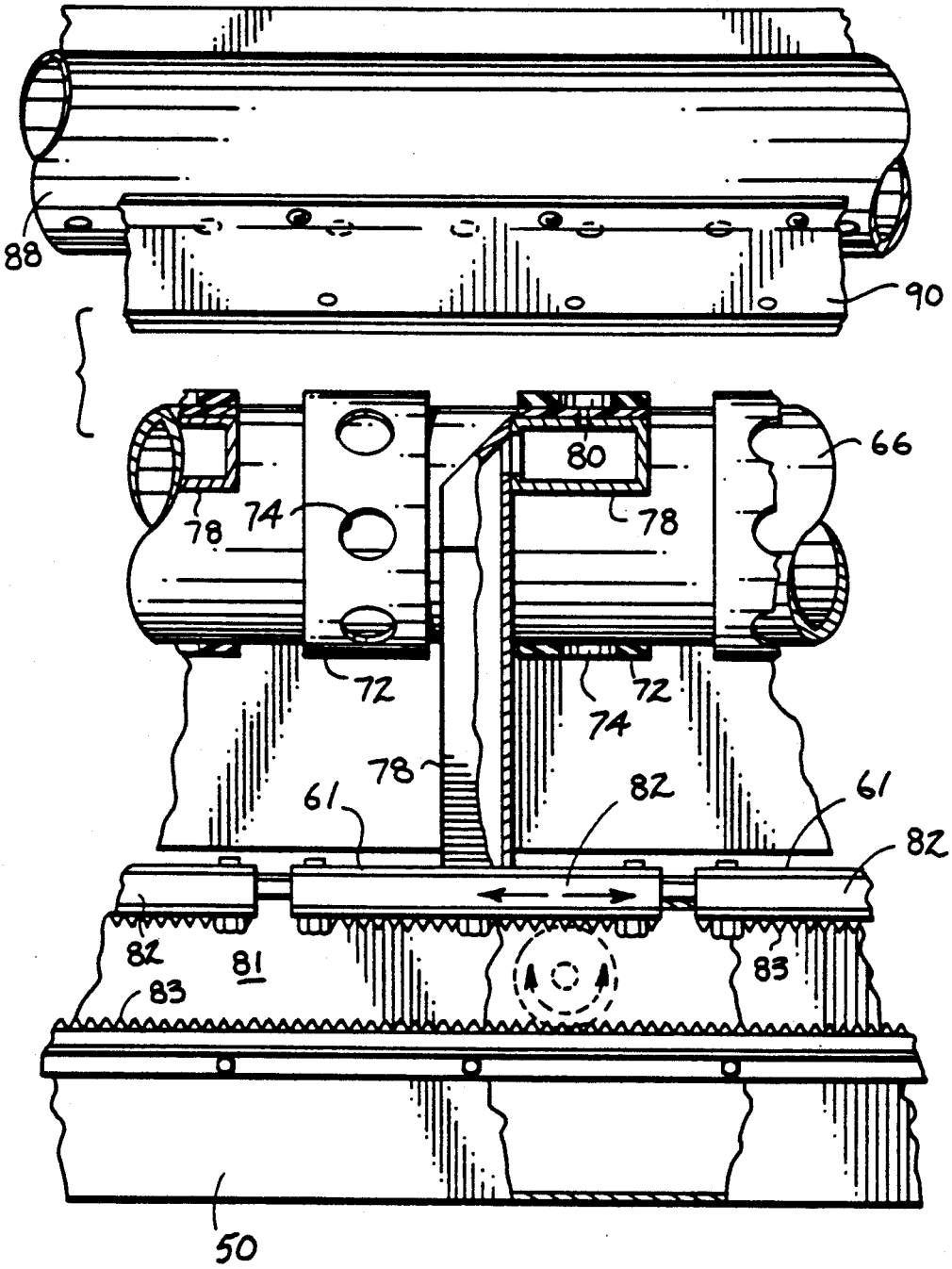
FIG. 8 is vertical cross sectional view taken along line 8—8 in FIG. 5 showing an isolated portion of the transfer conveyor.

The vacuum conveying assembly 52 further includes an air knife 88 that is illustrated in FIGS. 6–8 for directing a thin channel of air against the upper surface of the container blanks 12 on the infeed conveying section 62 for blowing trim material from the upper surface. The air knife has a throat 90 for accelerating the velocity of the air.

The vacuum conveying assembly 52 further includes a brush 92 that extends across the belts 72 on the outfeed conveying section 64 to additionally agitate and remove trim material that may be carried on the upper surface of the container blanks. A front edge guide 93 is mounted on the vacuum conveying assembly 52 in the form of a strip or sheet of plastic that extends across the outfeed conveyor belts with a trailing end projecting to the forward end of the brush 92 to facilitate the movement of each of the container blank 12 underneath the brush without damaging the forward edge 18 of each blank. Since the infeed and outfeed conveying elements 62 and 64 are laterally offset, it is very easy for loose material to fall between the conveying elements 61 so as not to interfere with the orderly stacking of the container blanks or to damage the container blanks with trim material interposed between layers and a stack.

The vacuum conveying assembly 52 further includes a nip roller assembly 94 (FIGS. 6 and 7) that is mounted thereon for receiving a forward edge 18 of the container blank 12 when discharged from the outfeed conveying section 64 and for impressing the forward end 18 and the container blank 12 onto the main conveying means 32 at a precise longitudinal location. The nip roller assembly 94 includes a carriage 96 supported on a support frame 98. The nip roller assembly 94 includes a pivot arm 100 mounted on a forward end. Nip rollers 102 are rotatably mounted on the pivot arm 100 for receiving and engaging the forward edge 18 of the container blank 12 (FIG. 7). Cylinder 104 is connected between the support frame 98 and the pivot arm 100 to raise or lower (engage or disable) the nip rollers. The carriage 96 may be moved forward or rearward to adjust the longitudinal location of the nip rollers 102.

Main Conveying Mains

The main conveying means 32 includes a plurality of laterally spaced vacuum conveying elements 108 that are mounted on a base frame 109 and extend from a rear receiving end 110 in a curved arc section 112 to a forward discharged end 114 that is shown in side view in FIG. 4 and in plan view in FIG. 5. It is important that the container blanks 12 be moved as rapidly as possible from the lower elevation at the rear end 110 to the upper elevation at the discharge end 114 without the container blanks passing over an abrupt corner (angle change) that would bend or crease the container blanks. Consequently the elements 108 extend upward in curved arcs starting at an incline angle of approximately 20 degrees and terminating in an upward incline forward end 114 of approximately 5 degrees to discharge the container blanks substantially horizontal when the blanks 12 are in free flight at the stacking station.

Figure 11:
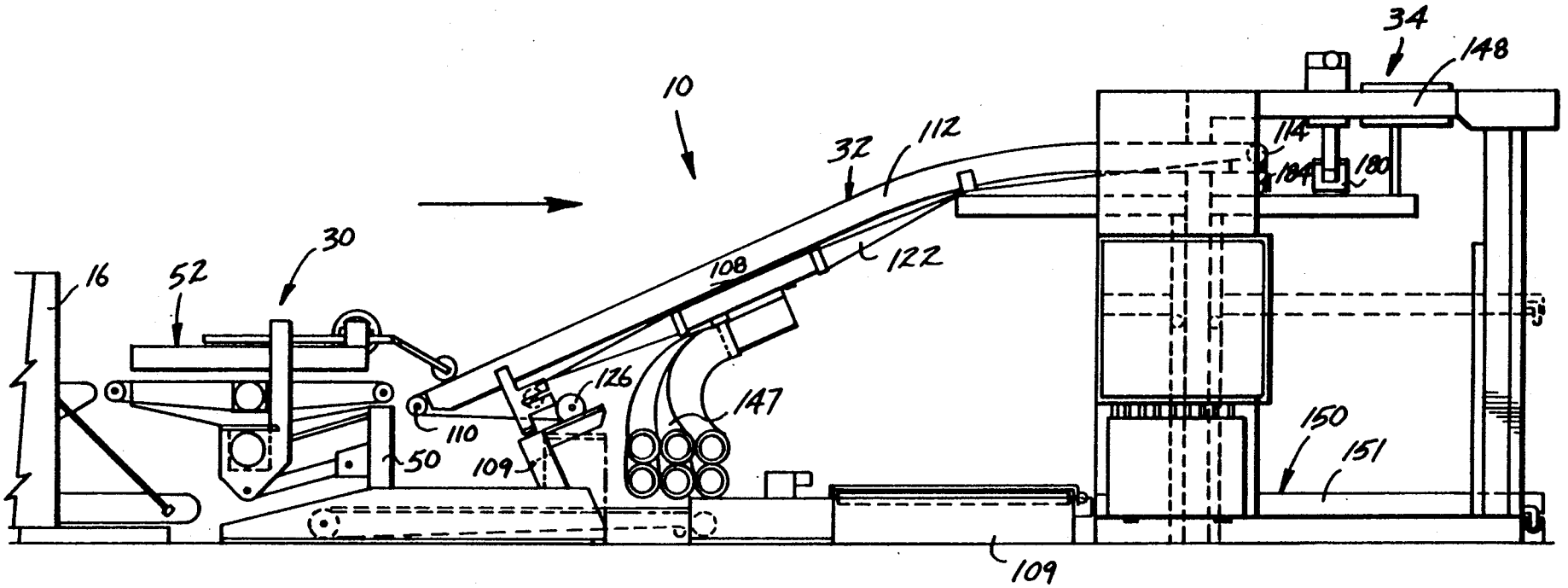
FIG. 11 is a vertical cross sectional view taken along line 11—11 in FIG. 5 illustrating a longitudinal section of the main conveyor of the stacker.
Figure 14:
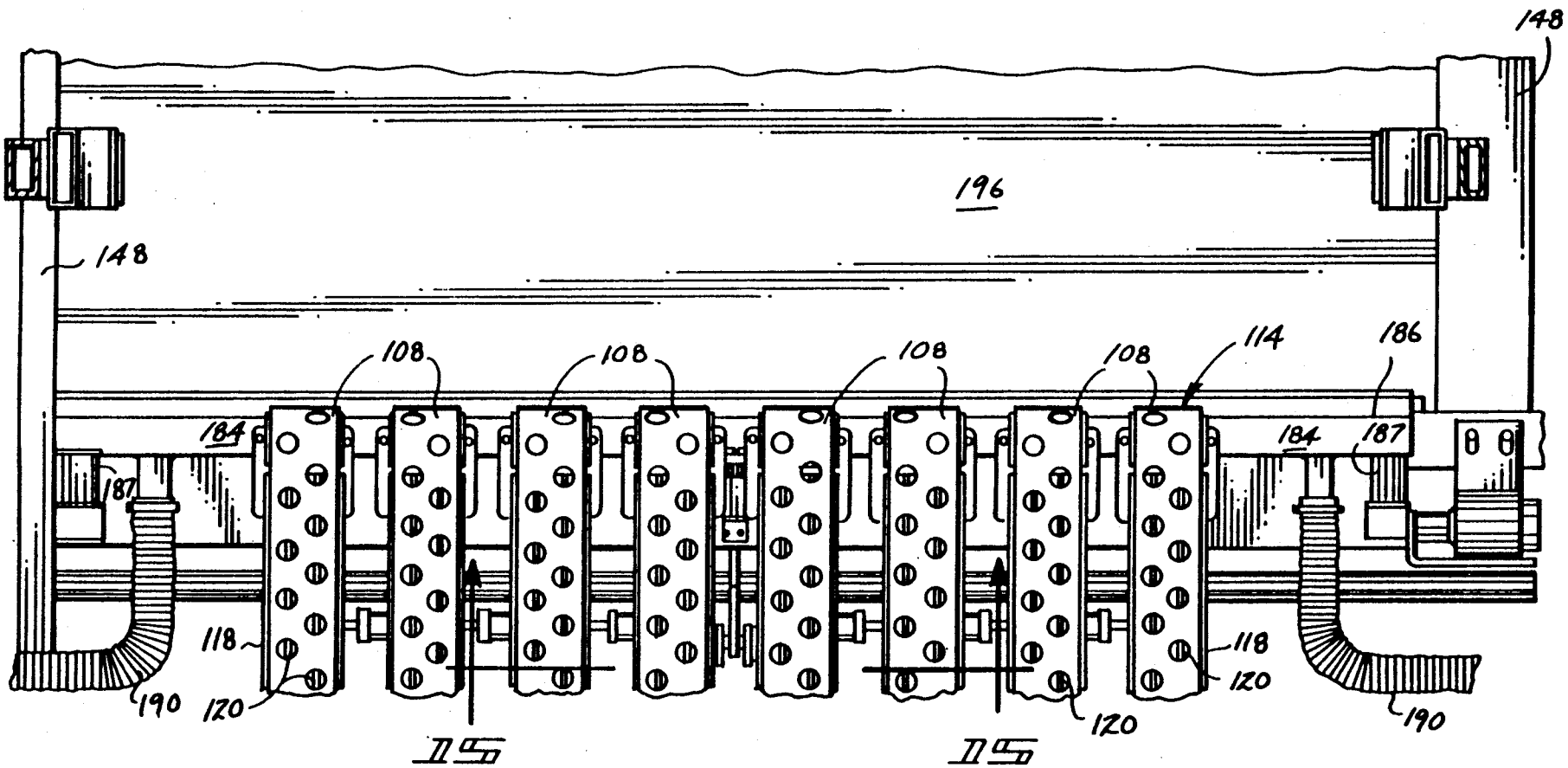
FIG. 14 is a fragmentary plan view of a forward end of the main conveyor illustrating a number of the conveyor elements that are laterally spaced from each other for delivering corrugated container blanks to a stacking station.
Figure 11:
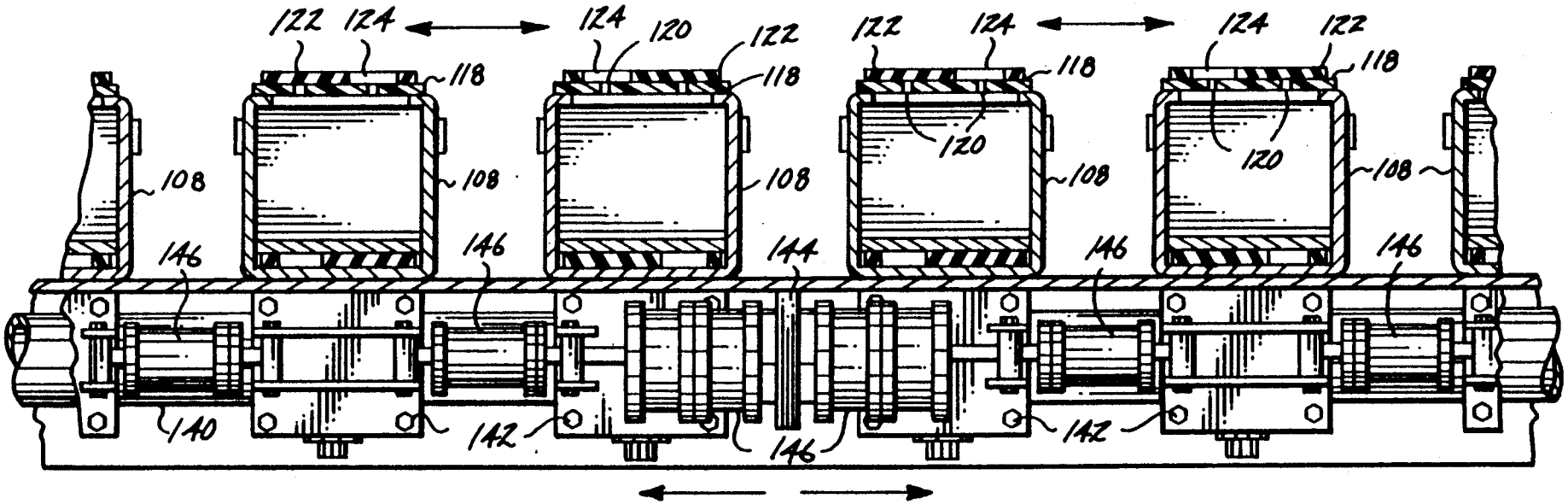
Figure 11:
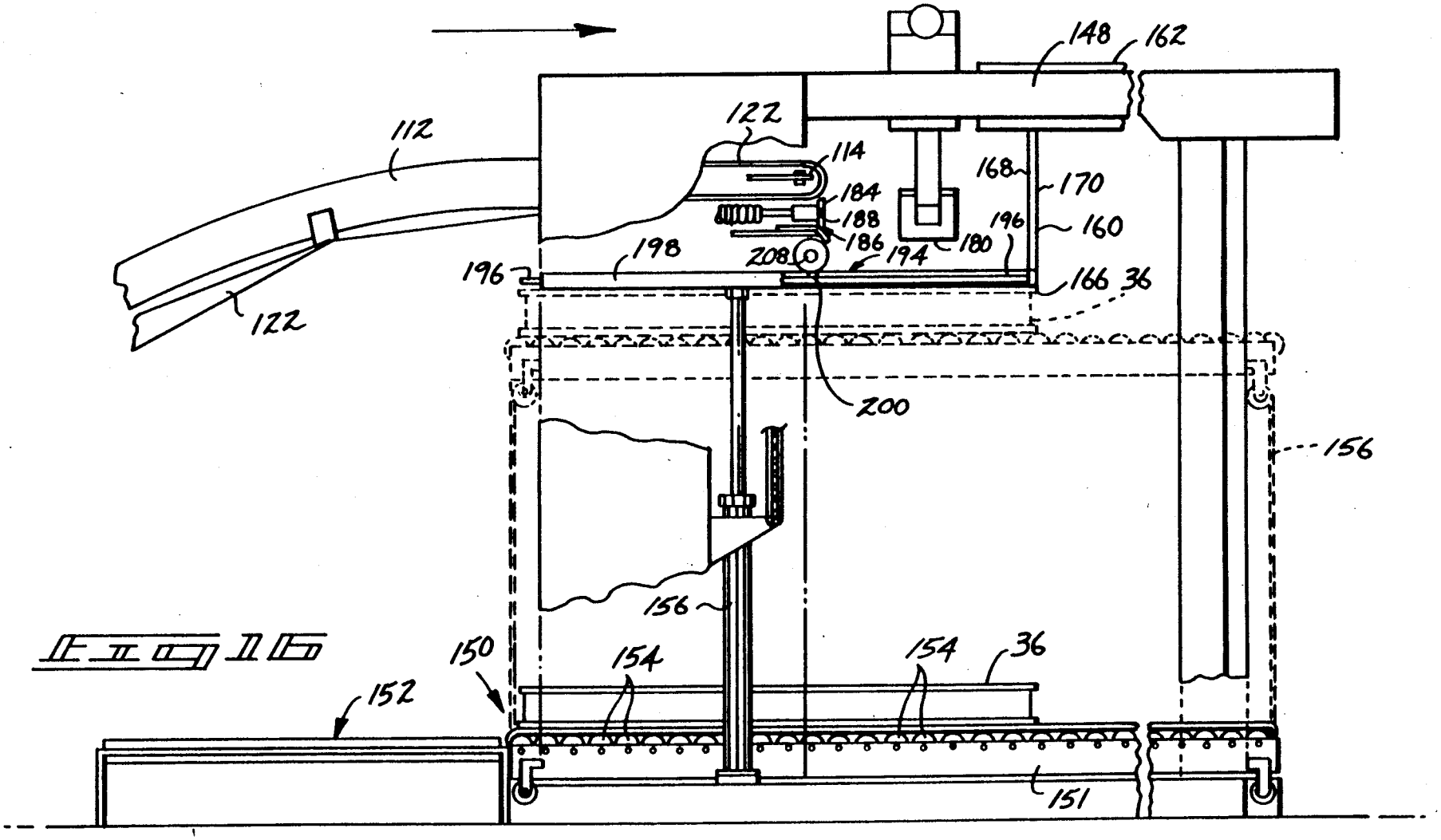

Each of the vacuum conveying elements 108 includes a vacuum plenum 116 (FIGS. 10 and 11) having a longitudinally arced upper surface 118 that defines the upper flight of the conveyor. Each vacuum plenum 116 includes two parallel slits 120 (FIGS. 10 and 14) that extend from the rear end 110 to the forward end 114 as illustrated in FIGS. 14 and 15. Each vacuum conveying element 108 further includes an endless conveying belt 122 that has apertures 124 formed therein to enable the vacuum pressure to be applied from the vacuum plenum 116 through the slots 120 and the apertures 124 to secure the container blanks 12 securely to the upper surface of the belts 122 on the upper flight of the vacuum conveyor elements 108.

Each of the belts 122 is entrained about a common drive roller 126 and individual rear wheels 128 and forward wheels 130. Each vacuum conveying element 108 has a support foot 132 adjacent the rear end 110 (FIGS. 6, 7, 10 and 13) that fits on a bearing 134 for enabling the rear end 110 of each of the vacuum conveying elements 108 to be moved laterally with respect to each other.

Each conveying element 108 includes a lateral adjustment drive or cylinder 136 (FIG. 13) as connected between adjacent conveying elements for adjusting the lateral position of the foot 132 in relation to the base frame 109. A belt tensioning pulley 138 is provided to be able to adjust the tension of each belt 122 on its respective vacuum plenum 116.

At the forward discharge end 114 of each conveying element 108, the base frame 109 includes a common transverse support rod 140 (FIGS. 14 and 15) for supporting the forward ends 114. Each of the conveying elements 108 at the forward end 114 includes a bearing block 142 depending therefrom that is laterally movable on the support rod 140. Lateral adjustment drives 146 are provided for each of the conveying elements 108 to laterally adjust the spacing between the forward ends of the conveying elements 108 as illustrated in FIGS. 14 and 15. Each lateral adjustment drive 146 is independently operable with the two center drives 146 connected to a base bar 144 which provides a stationary reference. Consequently the forward lateral adjustment drives 146 may be independently operated with respect to the rear lateral adjustment drives 136 to cause the vacuum conveying elements 108 to diverge from the rear end 110 to the upward end 114 to cause the side-by-side container blanks 12 to diverge and separate as illustrated in FIG. 2C. Furthermore the vacuum conveying elements 108 may be laterally adjusted to accommodate various numbers of side-by-side blanks 12 and their respective sizes to provide optimum support of the blanks 12 as they are conveyed from the transfer conveyor 30 to the stacking station.

The main conveying means 32 includes vacuum lines 147 (FIG. 5) connected from a vacuum source to each individual vacuum plenum 116.

Blank Stacking Means

The base frame 109 includes side frames 148 (FIGS. 14 and 16) at the stacking station that extend upward from floor level to an elevation above the forward end 114 of the main conveyer. Such side frames 148 are also illustrated in FIGS. 4 and 5 and encompass an elevator means 150 that is movable vertically at the stacking station between the side frames 148 for stacking the container blank 12 in the sequence illustrated in FIGS. 3A–C.

The elevator means 150 includes a platform 151 for receiving the storage surface or pallet 36. Although a pallet is preferable, other types of support surfaces 36 may be provided for supporting a plurality of rows of stacked container blanks.

Stacker 10 includes a pallet feeding means 152 for serially feeding pallets onto the platform 151 for receiving the stacks 38. The details of the pallet feeding means 152 are omitted as it is conventional.

The platform 151 has a plurality of rollers 154 for supporting a power driven belt to in turn move the pallets in the longitudinal direction with precision with respect to the direction of the main conveying means 32. The drive for the power rollers is not shown as it too is conventional. The elevator means 150 includes a vertical or hoist drive 156 for moving the platform vertically between an elevated blank receiving elevation and a lower transfer elevation illustrated in FIG. 16.

Figure 23:
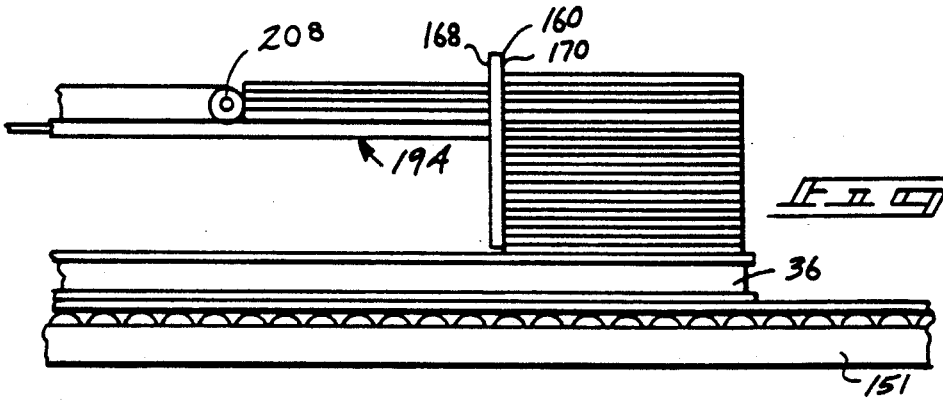
Figure 24:
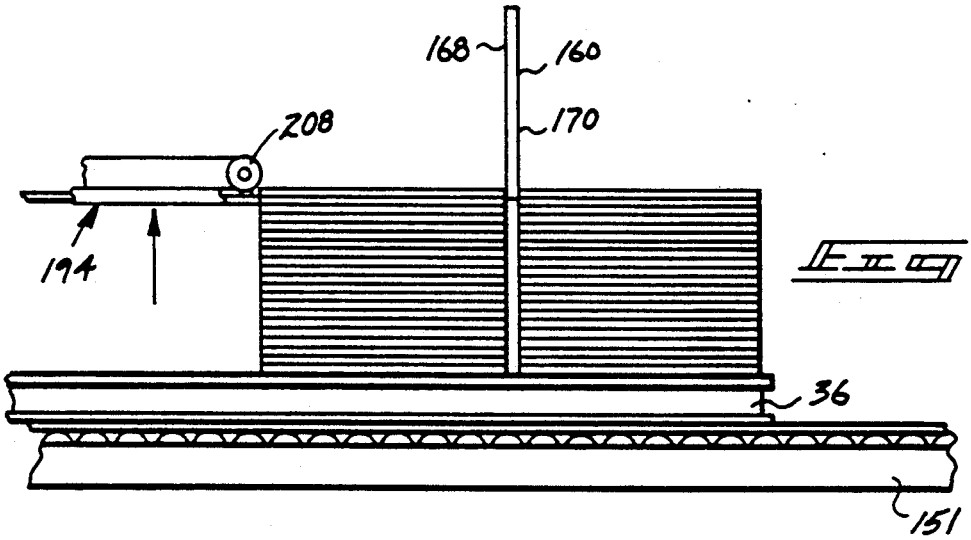
Figure 25:
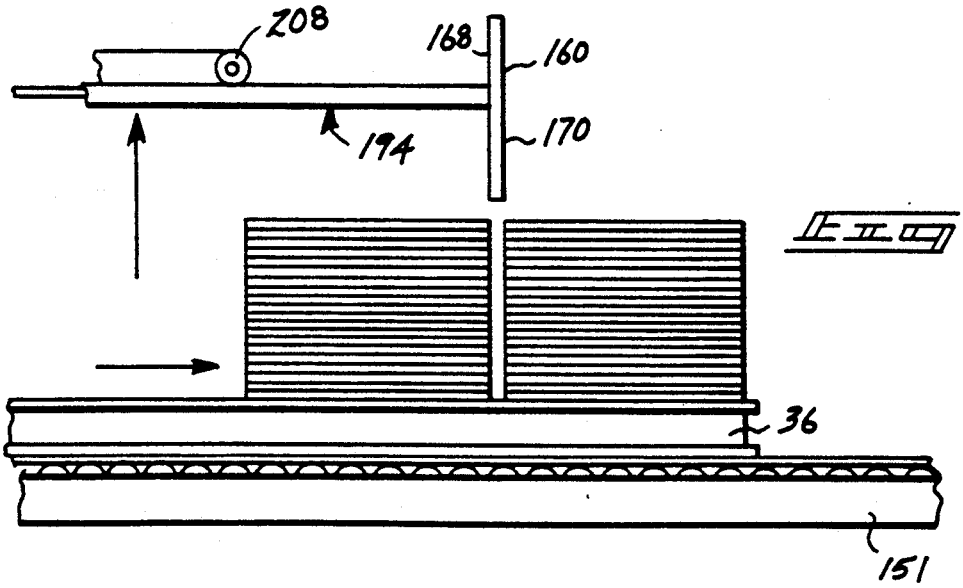
Figure 26:
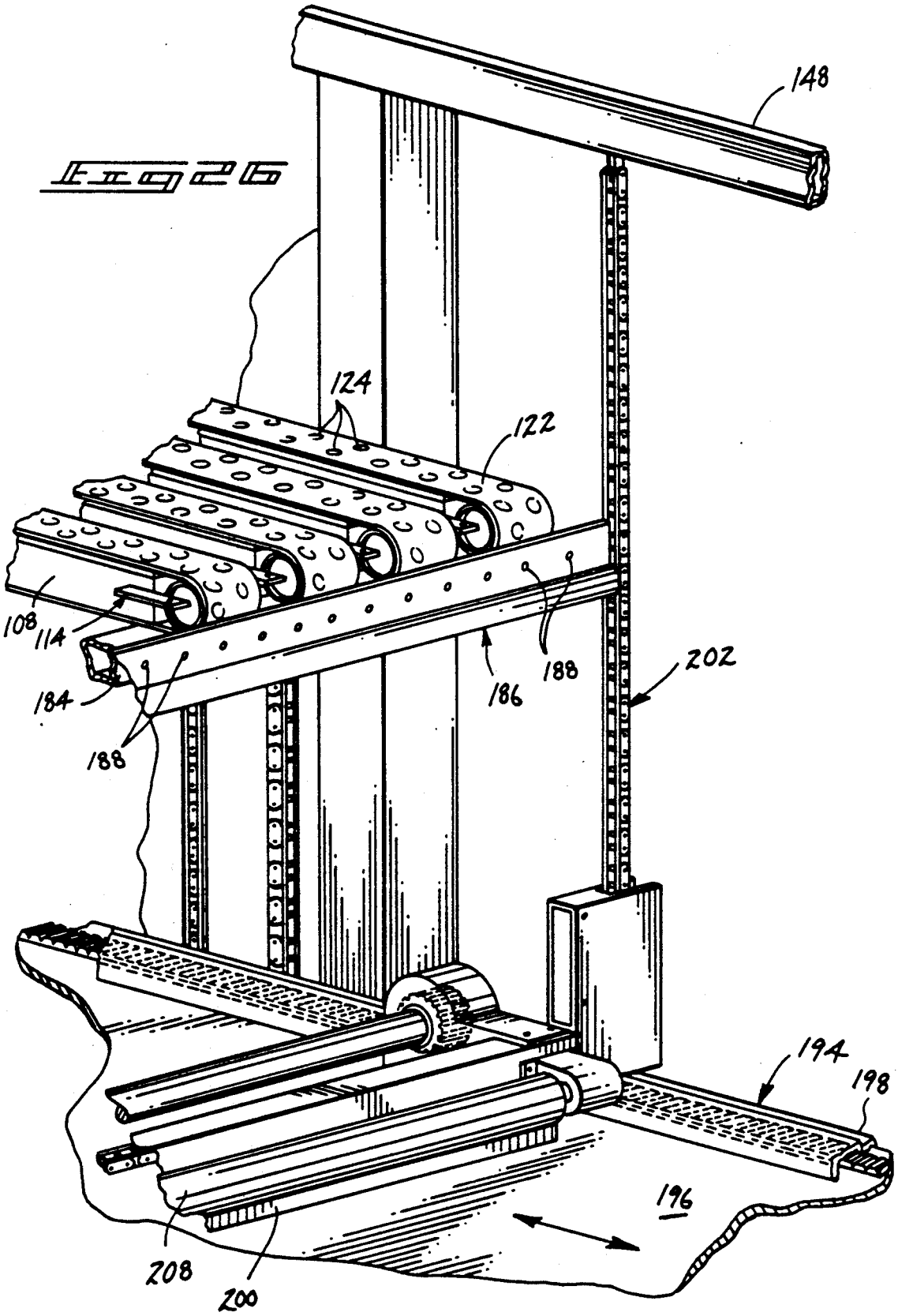
FIG. 26 is a detailed fragmentary perspective view of the stacking station showing drives for (1) raising and lowering and (2) extending and retracting a stripper plate in the formation of the stacks.
Figure 27:
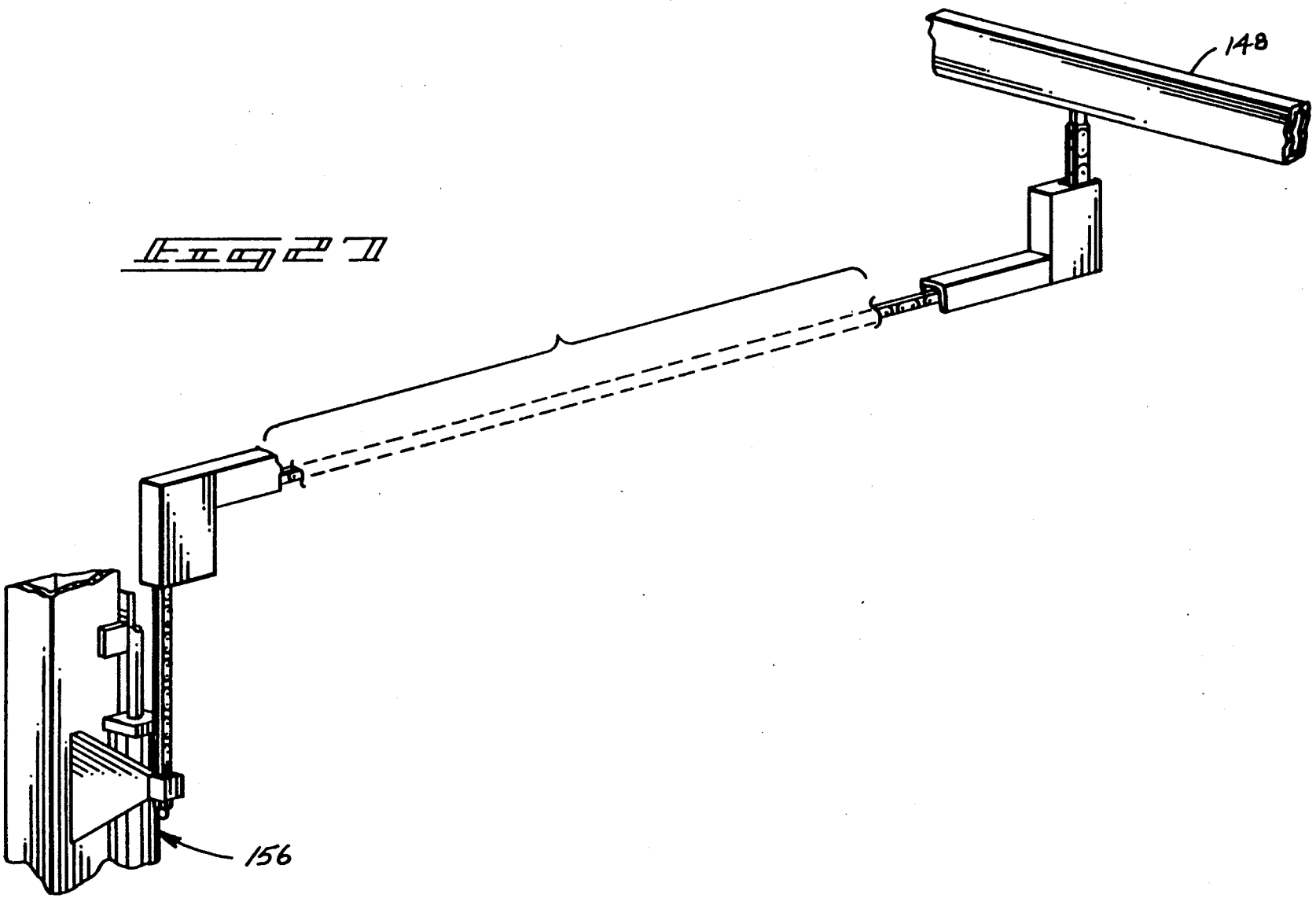
FIG. 27 is a isolated detailed view of the drive for incrementally lowering the stripper plate and for raising the stripper plate in the formation of initial partial stacks.

The blank stacking means 34 further includes a backstop 160 that is formed of a thin plate material. The backstop 160 is oriented vertically at the stacking stations and is supported upon a backstop carriage 162 that may be longitudinally adjusted on the side frames 148 to accommodate various sized container blanks. The backstop 160 extends downward from an elevation above the forward end 114 to a bottom edge 166 that is substantially below the forward end 114 to define a stacking chamber and to align the forward edge of each blank in the stack vertically coincident with each other. The backstop 160 includes a front face 168 that is engaged by the forward edge of each container element 12 as it is propelled in free flight from the forward discharge end 114. Additionally the backstop includes a rear face 170 (FIGS. 23–25) that provides support for the rear edge of container blanks in the stacks that are located in the immediate preceding row of stacks.

Figure 28B:
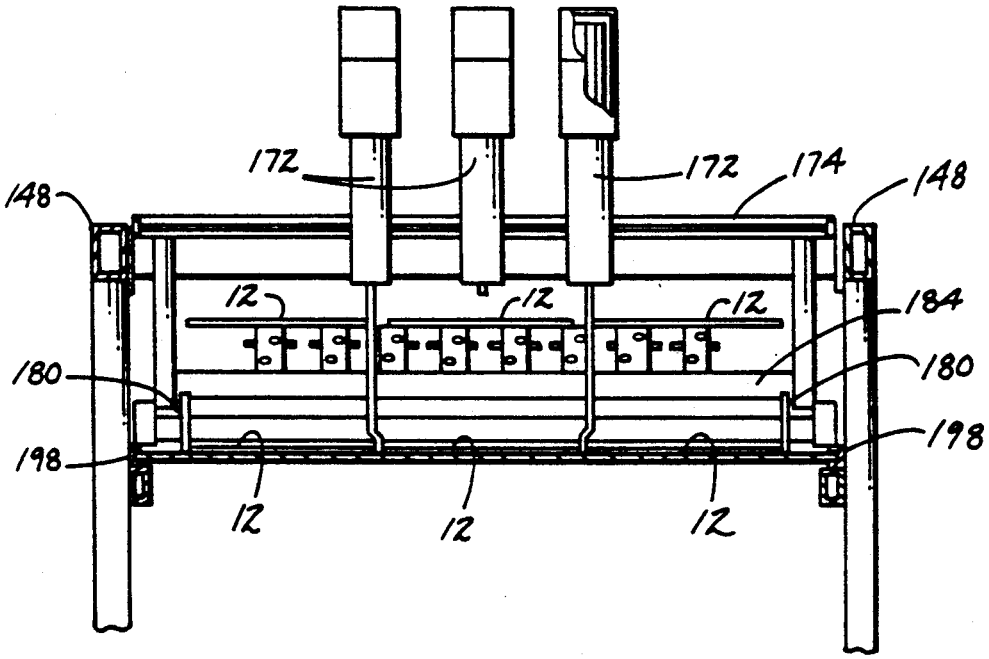
FIG. 28 is a vertical cross sectional view taken along line 28—28 in FIG. 5 showing dividers at a stacking station for laterally spacing the side-by-side blanks as they are being stacked.

The blank stacking means 34 includes dividers 172 (FIG. 28) that are mounted overhead of the stacking chamber for projecting downward into the stacking chamber to maintain separation between laterally adjacent container blank 12 as they are being stacked. For example if there are three side-by-side container blank stacks, then two dividers 172 would be utilized to separate the middle stack of container blanks from the two outside stacks. The dividers 172 are laterally movable on a rail 174. The dividers 172 are connected to vertically actuators to be raised and lowered as desired at selected lateral locations.

The blank stacking means 34 further includes side tampers 180 for vibrationally tamping the side edges of the outer container blanks as they are deposited on the formed stack and to move the outer blanks into engagement with the dividers 172.

Figure 17:
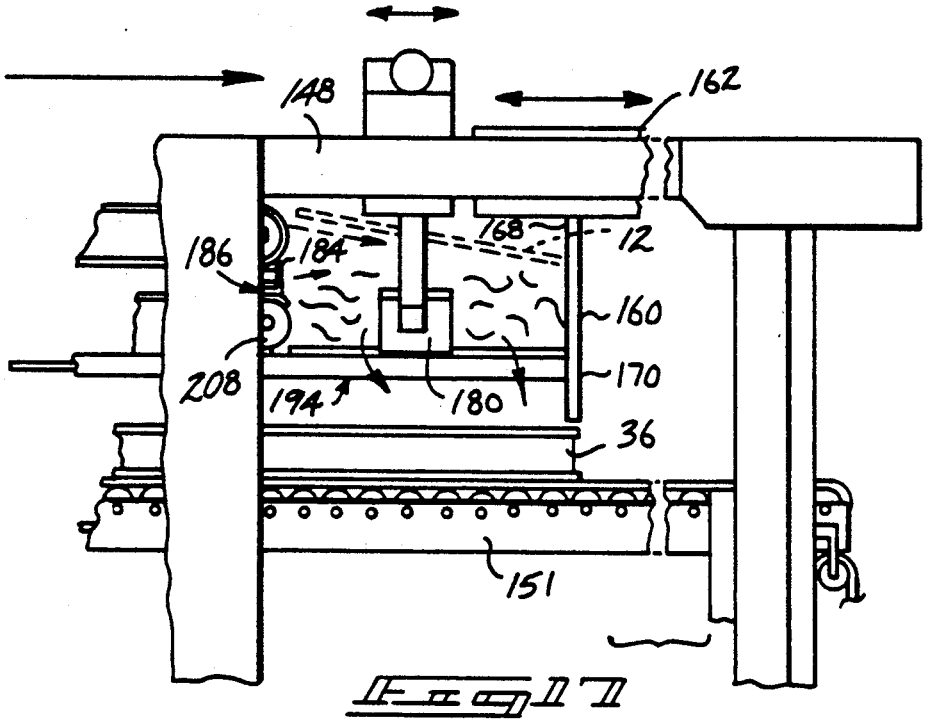
FIGS. 17–25 show a sequence of fragmentary side views, in schematic form, illustrating the formation of the stacks on the pallet shown in FIGS. 3A–C.
Figure 18:
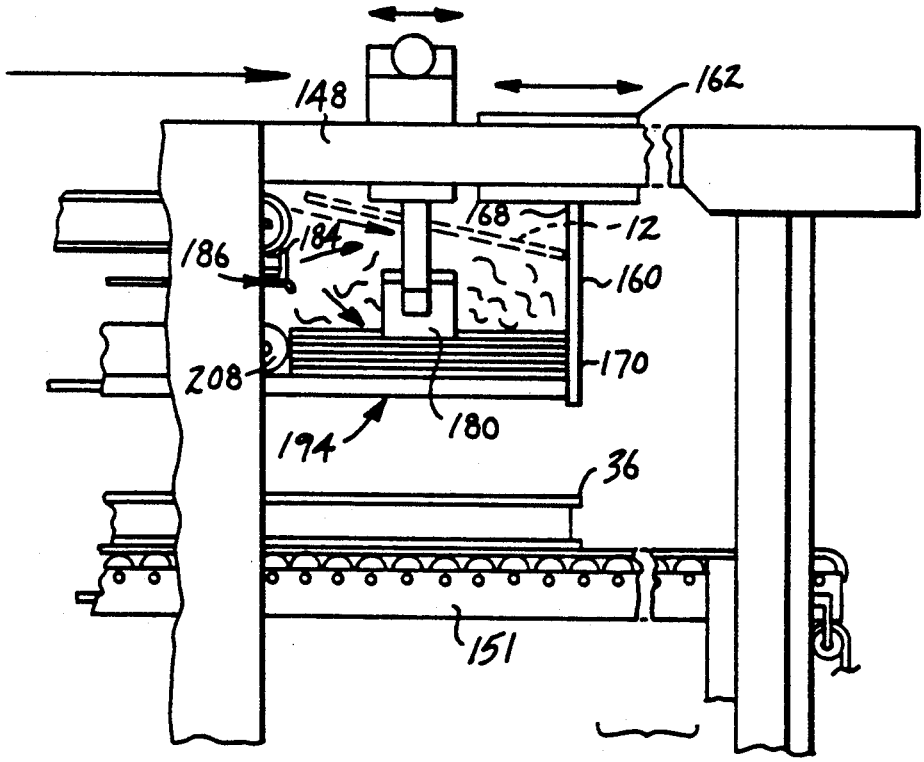
Figure 19:
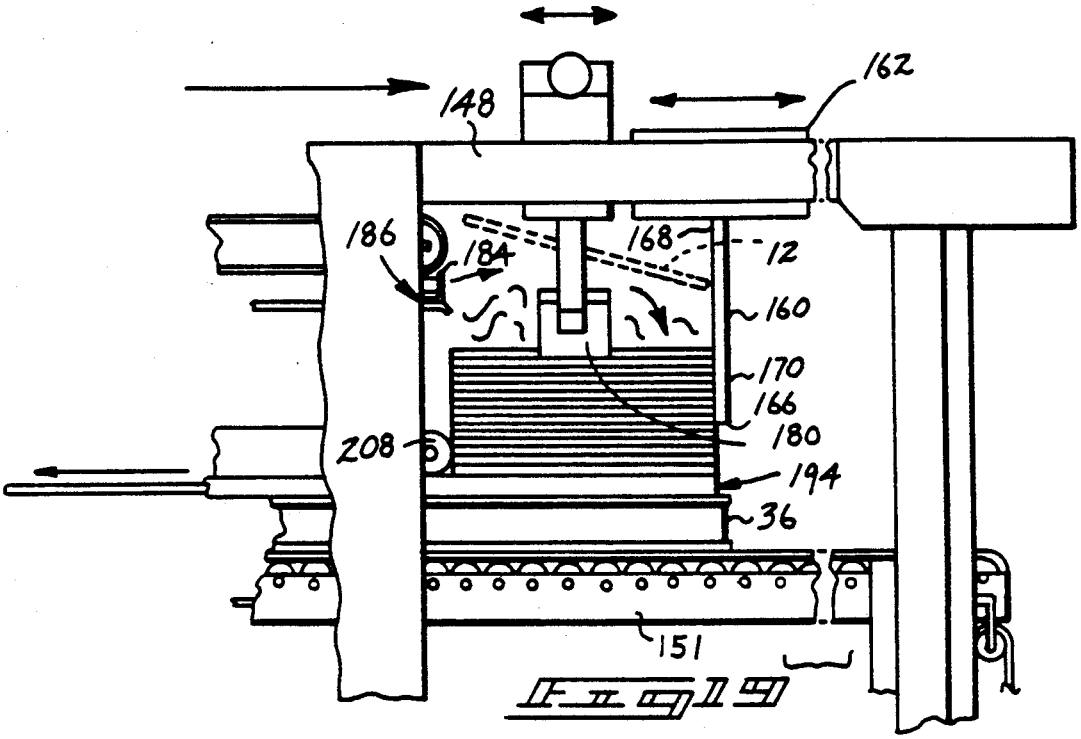
Figure 20:
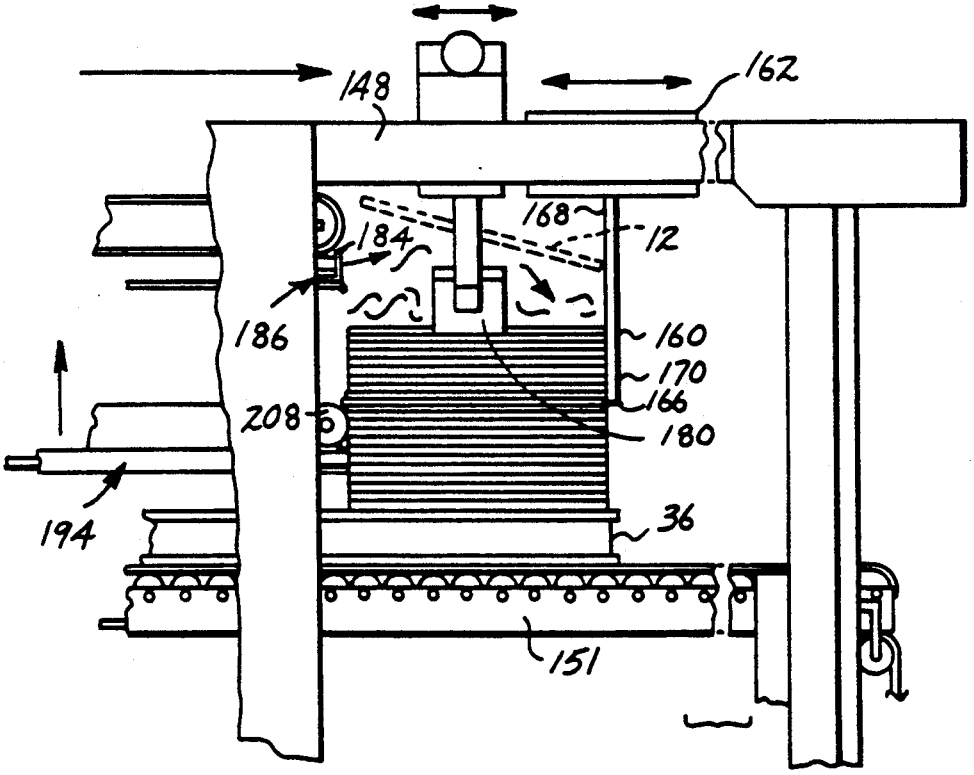

Furthermore the blank stacking means 34 includes a rear tamper 184 that extends transversely across the stacking chamber for engaging the rear edges of the container blank 112 as the container blanks are deposited upon the stack as illustrated in FIGS. 17 and 18. The rear tamper 184 includes a tamping face 186 that is rapidly cycled by air cylinders 187, illustrated in FIG. 14. Furthermore air ports 188 are formed in the tamping face 186 to permit a supply of injected air to be blown into the stacking chamber between a container blank that is supported on the stack and a container blank that is being propelling in free flight from the discharge end 114 to the backstop 160. The positive air pressure partially supports and floats the container blank in the free flight until the forward edge 18 engages the backstop 160. The positive air pressure prevents the forward edge of the container blank 12 from scraping or rubbing along the top surface of the stack being formed. The air ports 188 are connected to a positive air supply line 190 (FIG. 14). This feature is particularly useful in stacking rather large container blanks so as to prevent rubbing between the upper surface of the stack and the lower surface of the descending container blank as it descends onto the stack. It is not unusual for a container blank to have various edge and body configurations, including apertures, that could be easily engaged by the forward end of the succeeding blank and damage both blanks, or prevent the blanks from stacking precisely on top of each other.

The blank stacking means 34 includes an interim support assembly 194 for temporarily supporting a portion of a stack to permit the elevator means to lower the platform 151 to the lower transfer elevation and to move the pallet incrementally forward and then to raise the pallet to the raised receiving position to receive a second row of stacks 38, etc. The interim support assembly 194 is vertically movable to increment downward with the addition of succeeding container blanks to prepare partial stacks and to then deposit the partial stacks onto a raised platform 151.

The interim support assembly 194 includes a horizontally positioned movable support or stripper plate 196 that extends between edge support guides 198 adjacent the side frames 148. The movable stripper plate 196 is movable horizontally from an extended position in which the plate extends outward into the stacking chamber with a forward edge of the plate adjacent with the front face 168 of the backstop 160. The stripper plate 196 is retracted to a retracted position underneath the forward end 114 of main conveyor and beneath the rear tamper 184.

The interim support assembly 194 has a horizontally stationary stripped bar 200 vertically above the stripper plate 196 for stripping partial stacks that are supported on the movable plate 196 from the plate 196 and onto the platform 151. The movable stripper plate 196 is movable by a vertical drive 202 for incrementally moving the plate 196 downward as succeeding container blanks are received in the stacking chamber. After a partial stack is stripped, the assembly 194 is then raised to a vertical position to be ready to start a new stack.

The interim support assembly 194 further includes a stack edge aligning means, that is preferably in the form of roller 208, positioned immediately above the stripper bar 200 to engage the rear edges of the stacked container blanks after the container blanks have been deposited onto the pallet. It is not usual for several of the sheets to move relative to each other as a partial stack is being transferred from the stripper plate 196 to the pallet. As the movable support assembly 194 is moved upward, the roller 208 engages the rear edges and pushes the misaligned rear edges forward to regain alignment of the rear edge as the carriage is moved upward in preparation to start a new stack.

Figure 21:
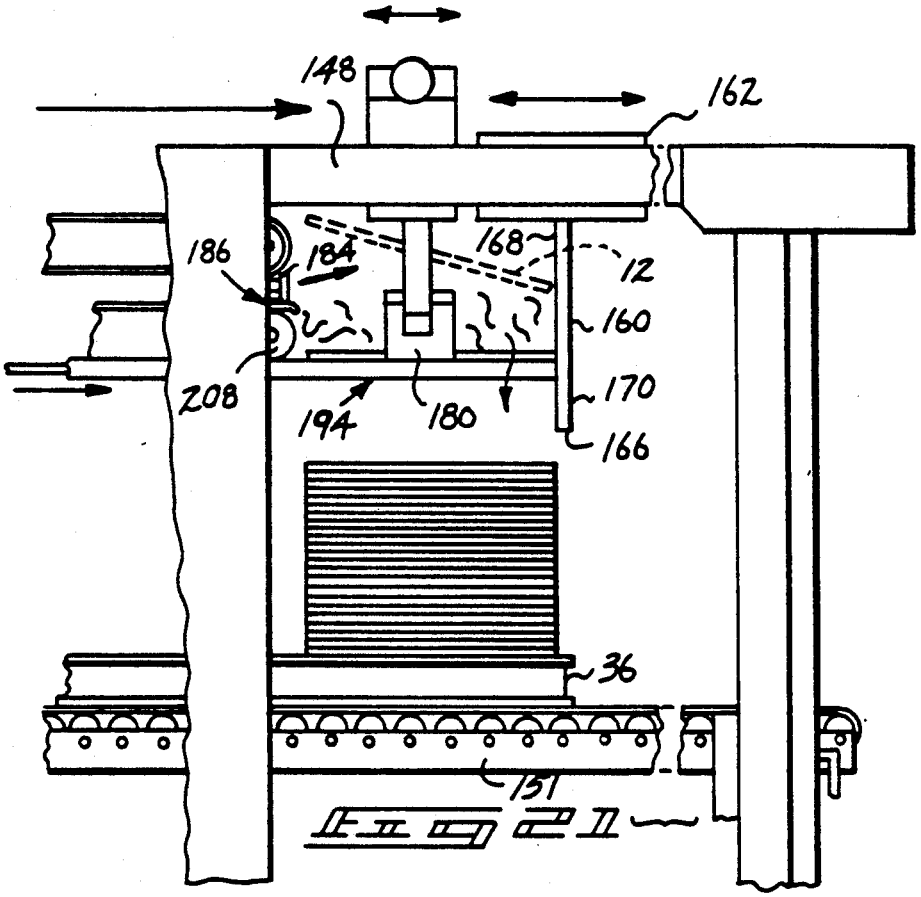
Figure 22:
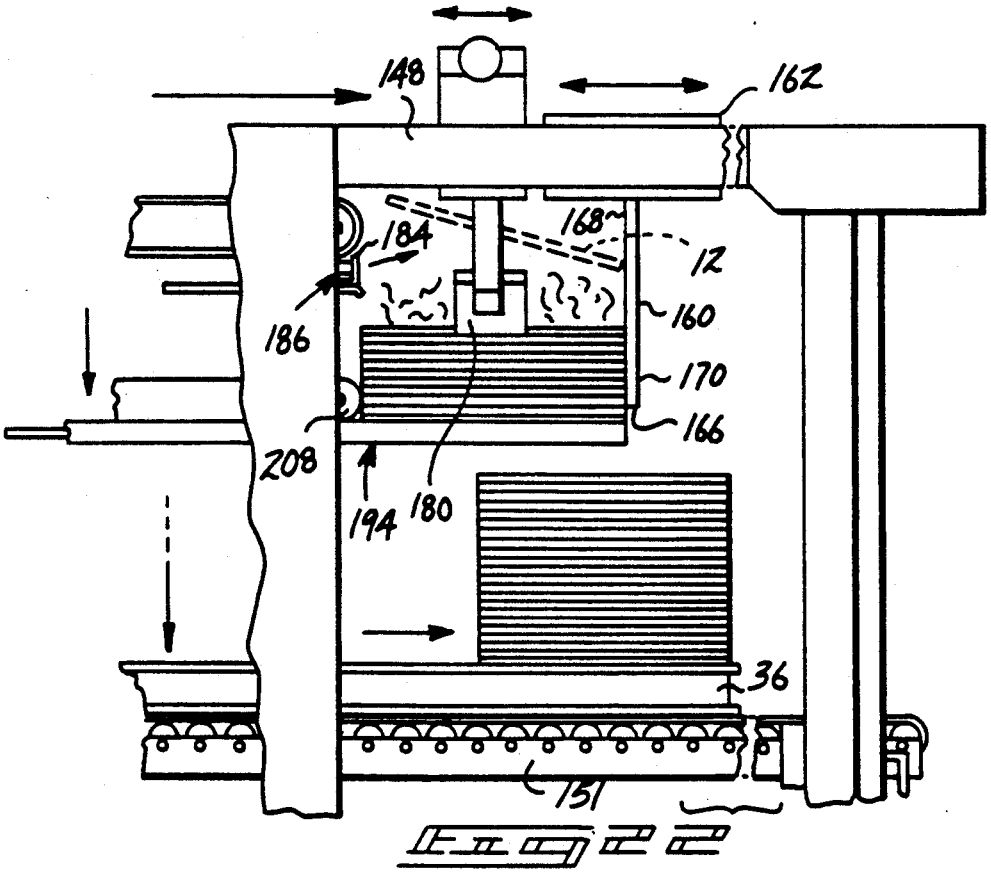

The stack is continued to be formed as the elevator means moves the platform 151 incrementally downward until the correct number of container blanks are contained in the row of stacks. At this point, the elevator drive 156 is actuated to lower the row of stacks beneath the bottom edge 166 of the backstop and then to move the pallet 36 forward as illustrated in FIGS. 21 and 22, positioning the formed row of stacks immediately behind the backstop 160. As the elevator drive is actuated to lower the completed stack, the interim support assembly 194 is activated to extend the stripper plate 196 into the stacking chamber to receive succeeding rows of container blanks 12 to continue the stacking process. The previous row of stacks is being moved forward on the pallet and then upward as illustrated in FIG. 22 to position the previous row immediately behind the backstop 160. The rear face 170 of the backstop 160 maintains the rear edges 22 in vertical alignment.

As soon as a partial load has been completed, the partial load will be deposited on the pallet 36 with the platform continuing downward until the second full row of stacks has been formed. This process will be continued until the third row of stacks is placed on the pallet as illustrated in FIG. 3C.

When the pallet 36 has received a correct number of rows of stacks, then the pallet is moved to an adjacent conveying structure for storage and a new pallet is moved into position on the platform 151.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A corrugated container blank stacker for receiving rows of side-by-side corrugated container blanks from a corrugated sheet cutter and for stacking such corrugated container blanks in multiple rows of side-by-side stacks on a storage surface at a stacking station, comprising:

conveying means for successfully conveying rows of side-by-side container blanks in paths in a forward direction from the corrugated sheet cutter to the stacking station;

backstop means mounted vertically at the stacking station intercepting the paths of the container blanks for engaging the leading edges of the blanks and allowing the blanks to descend onto the storage surface;

an elevator means at the stacking station for incrementally moving the storage surface downward from an upper support position to a lower support position to form a row of stacks on the storage surface when a prescribed number of blanks descend upon the support surface and for moving the storage surface upward to the backstop means from the lower support position to the upper support position in preparation for receiving blanks to form a succeeding row of stacks on the storage surface;

stack indexing means responsive to the formation of the row of stacks on the support surface and the movement of the elevator means to the lower support position for moving the support surface forward underneath the backstop to locate the formed row immediately forward of the backstop prior to the elevator means moving the storage surface with the formed row thereon upward to receive the container blanks for the succeeding row of stacks on the storage surface with the formed row immediately forward of the backdrop to thereby form multiple rows of stacks of the container blanks on the storage surface;

an interim stack supporting means mounted at the stacking station for vertical movement between an upper receiving position and a lower discharge position for receiving the successive rows of container blanks and forming partial stacks and for discharging the partial stacks onto the storage surface; and stack straightening means supported on the interim stack supporting means for engaging and straightening the partial stack as the interim stack support means moves upward from the lower discharge position.

2. The corrugated container blank stacker as defined in claim 1 wherein the stack indexing means includes drive means for incrementally moving the storage surface forward after each row has been formed and the elevator means has moved the formed stack to the lower support position beneath the backstop means.

3. The corrugated container blank stacker as defined in claim 1 further comprising tamping means for engaging the side and rear edges of the container blanks for maintaining the edges in vertical alignment with each other in the stack.

4. The corrugated container blank stacker as defined in claim 1 further comprising positive air pressure means at the stacking station for injecting air beneath the container blanks as they descend upon the stack to prevent rubbing of the container blanks as they are being placed on the stack.

5. The corrugated container blank stacker as defined in claim 1 further comprising an interim stack supporting means mounted for vertical movement between an upper receiving position and a lower discharge position for supporting a stack as it is being formed when elevator means is moving the storage surface forward.

6. The corrugated container blank stacker as defined in claim 5 further comprising stack straightening means supported on the interim stack supporting means for straightening the stack after the stack has been deposited on the support surface and as the interim stack supporting means moves upward from the lower discharge position.

7. A corrugated container blank stacker for receiving rows of side-by-side corrugated container blanks from a corrugated sheet cutter at a prescribed lower elevation and for stacking such corrugated container blanks in side-by-side stacks on a storage surface at a stacking station, comprising:

an elevator at the stacking station for incrementally moving the storage surface downward from an elevated position in response to successively receiving rows of the side-by-side container blanks to form side-by-side stacks on the storage surface;

a backstop at the stacking station at the elevated position for vertically aligning leading edges of the container blanks in the side-by-side stack;

a vacuum conveyor having a curved upper flight for receiving the side-by-side corrugated container blanks at the prescribed lower elevation from the corrugated sheet cutter and for successively conveying rows of the side-by-side container blanks forward in an upward curved path from the prescribed lower elevation at an initial upward inclined angle and then progressively at decreasing inclined angles to the elevated position at a slight upward inclined angle and propelling the container blanks against the backstop;

said vacuum conveyor having a plurality of laterally spaced elongated arched vacuum plenums defining the upper conveyor flight extending upward from rear ends at the lower elevation to forward ends adjacent to elevated position in a curved upward extending arc;

said vacuum conveyor having a plurality of perforated belts entrained about the vacuum plenums for receiving side-by-side container blanks thereon at the lower elevation and conveying successive rows of container blanks upward from the lower elevation in the curved path to the elevated position;

vacuum means communicating with the vacuum plenum for applying vacuum pressure to the plenums and through the perforated belts to secure the container blanks to the arched upward conveyor flights of the belts; and a transfer conveyor intermediate the corrugated sheet cutter and the vacuum conveyor for conveying the side-by-side blanks from the corrugated sheet cutter to the vacuum conveyor.

8. The corrugated container blank stacker as defined in claim 7 wherein the vacuum conveyor includes: (1) plenum supporting means individually supporting laterally spaced vacuum plenums for enabling the vacuum plenums to be moved laterally with respect to each other; and (2) laterally drive means operatively connected to the vacuum plenums for moving the vacuum plenums laterally to adjust the spacing between adjacent vacuum plenums.

9. The corrugated container blank stacker as defined in claim 8 wherein the lateral spacing means includes individual drive corresponding to each vacuum plenum for independently moving each vacuum plenum laterally.

10. The corrugated container blank stacker as defined in claim 8 wherein the lateral spacing means includes a rear adjustment means operatively connected to the rear ends of the vacuum plenums for independently laterally adjusting the rear ends relative to the forward ends.

11. A corrugated container blank stacker for receiving rows of side-by-side corrugated container blanks from a corrugated sheet cutter and for stacking such corrugated container blanks in side-by-side stacks on a storage surface at a stacking station; comprising:

an elevator at the stacking station for incrementally moving the storage surface downward from an elevated position in response to receiving successive rows of container blanks to form a row of side-by-side stacks on the storage surface;

a backstop at the stacking station at the elevated position for vertically aligning front edges of the container blanks in the side-by-side stacks as the stacks are being formed;

a main conveyor for receiving the side-by-side container blanks at a lower elevation and successively conveying rows of the container blanks from the lower elevation in a conveying direction to the elevated position and propelling the container blanks against the backstop;

a transfer conveyor for successively receiving and supporting the side-by-side container blanks from the corrugated sheet cutter and delivering the rows of the container blanks in succession onto the main conveyor in the conveying direction at the lower elevation with each row of container blanks spaced from each other;

said transfer conveyor having a hoist means for moving the transfer conveyor from a lower operating position at the lower elevation with the transfer conveyor in operational alignment with the corrugated sheet cutter to an upper nonoperating position spaced from the corrugated sheet cutter to provide access to the corrugated sheet cutter.

12. The corrugated container blank stacker as defined in claim 11 wherein said transfer conveyor includes:

a base frame;

a transfer conveyor assembly pivotally mounted on the base frame for movement from the lower operating position with the transfer conveying assembly operationally aligned with the corrugated sheet cutter to the upper nonoperating position spaced from the corrugated sheet cutter to provide access to the sheet cutter;

transfer conveyor hoist means mounted on the base frame and operatively connected to the transfer conveying assembly to selectively pivot the transfer conveying assembly from the lower position to the upper nonoperating position.

13. The corrugated container blank stacker as defined in claim 12 wherein the transfer conveyor includes tilting means operatively connected between the base frame and the transfer conveying assembly for tilting the transfer conveying assembly to adjust the inclination of the transfer conveying assembly in relation to the main conveyor.

14. The corrugated container blank stacker as defined in claim 11 wherein the transfer conveyor has a plurality of laterally spaced vacuum conveying elements for receiving the side-by-side container blanks from the corrugated sheet cutter and delivering rows of the container blanks onto the main conveyor; and each vacuum conveying element having an infeed conveying section with an upper flight for receiving a container blank from the corrugated sheet cutter and an outfeed conveying section that is laterally offset and longitudinally overlapping the infeed conveying section for delivering the container blank to the main conveyor to facilitate gravity discharge of loose corrugated sheet material from the container blank.

15. The corrugated container blank stacker as defined in claim 11 wherein the transfer conveyor has brush means for engaging the upper surface of the side-by-side container blanks to brush away loose corrugated sheet material from the upper surfaces of the side-by-side container blanks.

16. The corrugated container blank stacker as defined in claim 15 wherein the transfer conveyor has a leading edge guide for receiving and guiding leading edges of the container blanks in the conveying direction beneath the brush means to minimize damage to the leading edges of the container blanks by the brush means.

* * * * *